US006989719B2

(12) United States Patent
Takadate et al.

(10) Patent No.: US 6,989,719 B2
(45) Date of Patent: Jan. 24, 2006

(54) NON-RECIPROCAL CIRCUIT ELEMENT WITH REDUCED SHIFT OF CENTER FREQUENCY OF INSERTION LOSS WITH CHANGE IN TEMPERATURE AND COMMUNICATION DEVICE

(75) Inventors: Kinshiro Takadate, Niigata-ken (JP); Hitoshi Onishi, Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 108 days.

(21) Appl. No.: 10/706,335

(22) Filed: Nov. 12, 2003

(65) Prior Publication Data

US 2004/0095216 A1 May 20, 2004

(30) Foreign Application Priority Data

Nov. 19, 2002 (JP) ..... 2002-334999

(51) Int. Cl.
*H01P 1/383* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,317,010 B1 * 11/2001 Butland et al. ..... 333/1.1

FOREIGN PATENT DOCUMENTS

JP 11-283821 10/1999

* cited by examiner

*Primary Examiner*—Steven E. Jones
(74) *Attorney, Agent, or Firm*—Brinks Hofer Gilson & Lione

(57) ABSTRACT

A non-reciprocal circuit element includes a magnetic plate, a common electrode, a first main segment, a second main segment, a third main segment, and a magnet opposing to the magnetic plate and the magnet applying a bias magnetic field. The temperature coefficient of the saturation magnetization of the magnetic plate is from −0.2%/° C. to −0.1%/° C. in the temperature range from −35° C. to 85° C. The temperature coefficient of the residual magnetization of the magnet is from −0.20%/° C. to −0.15%/° C. in a temperature range from −35° C. to 85° C.

8 Claims, 14 Drawing Sheets

NON-RECIPROCAL CIRCUIT ELEMENT WITH REDUCED SHIFT OF CENTER FREQUENCY OF INSERTION LOSS WITH CHANGE IN TEMPERATURE AND COMMUNICATION DEVICE

BACKGROUND OF THE INVENTION

1. Field of the Invention

The present invention relates to a non-reciprocal circuit element and a communication device, and in particular, to a non-reciprocal circuit element with a reduced shift of a center frequency of an insertion loss with change in temperature.

2. Description of the Related Art

Lumped constant isolators are high-frequency components allowing signals to pass in the transmission direction without loss and preventing the signals from passing in the opposite direction. The isolators are disposed between a transmitting circuit and an aerial for use in a communication device, such as a cellular phone.

The isolator mainly includes a magnetic plate, three main segments folded around the magnetic plate, and a magnet for applying a bias magnetic field to the magnetic plate. The magnetic plate is composed of, for example, yttrium-iron-garnet ferrite (hereinafter referred to as YIG ferrite (basic composition $Y_3Fe_5O_{12}$)), and the magnet is composed of ferrite.

A related technical document of the isolator includes, for example, Japanese Unexamined Patent Application Publication No. 11-283821.

A temperature coefficient of the saturation magnetization of a typical YIG ferrite is about −0.27%/° C. in a temperature range from −35° C. to 85° C. A temperature coefficient of the residual magnetization of the ferrite magnet is about −0.18%/° C. in the same temperature range. The absolute value of the difference between both of the temperature coefficients is about 0.09. That is, the decreasing rate of the saturation magnetization of the YIG ferrite is widely larger than the decreasing rate of the residual magnetization of the magnet. Therefore, the ratio of the residual magnetization of the magnet to the saturation magnetization of the YIG ferrite becomes large as temperature decreases. Unfortunately, this phenomenon decreases the inductance of the main segments, widely shifts a center frequency of the insertion loss from the preset value, and increases the insertion loss of the isolator.

SUMMARY OF THE INVENTION

In view of the problems described above, it is an object of the present invention to provide a non-reciprocal circuit element with a reduced shift of center frequency of insertion loss with change in temperature and to provide a communication device having a superior communication performance.

In order to achieve the above object, a non-reciprocal circuit element of the present invention includes a magnetic plate; a common electrode disposed at one face of the magnetic plate; a first main segment; a second main segment; a third main segment; the three main segments extending from the periphery of the common electrode in three directions so as to surrounding the magnetic plate, the three main segments being folded to the other face of the magnetic plate and intersecting on the other face with predetermined angles, and a magnet for applying a bias magnetic field, and the magnet opposing to the magnetic plate, wherein the temperature coefficient of the saturation magnetization of the magnetic plate is from −0.2%/° C. to −0.1%/° C. in a temperature range from −35° C. to 85°, and the temperature coefficient of the residual magnetization of the magnet is from −0.20%/° C. to −0.15%/° C. in a temperature range from −35° C. to 85° C.

According to the non-reciprocal circuit element, the temperature coefficient of the saturation magnetization of the magnetic plate is from −0.2%/° C. to −0.1%/° C. This temperature coefficient of the saturation magnetization of the magnetic plate is larger than that of a typical YIG ferrite, and close to the temperature coefficient of the residual magnetization of the magnet. Accordingly, the ratio of the residual magnetization of the magnet to the saturation magnetization of the magnetic plate becomes substantially constant regardless of a temperature decrease. Therefore, the inductances of the main segments become constant, and the center frequency of the insertion loss does not shift from the preset value, thereby preventing the insertion loss of the non-reciprocal circuit element from increasing.

According to the non-reciprocal circuit element of the present invention, a ferromagnetic resonance half-width ΔH of the magnetic plate is preferably 4.8 kA/m or less, more preferably 2.4 kA/m or less.

The ferromagnetic resonance half-width ΔH is known as a half-width of the peak indicating imaginary part $\mu''$ of a magnetic permeability. In a measurement of the magnetic permeability of a typical magnetic material, the magnetic permeability is measured in the magnetic field direction. On the other hand, a magnetic permeability of the magnetic material is also measured under a condition that a high-frequency field is applied to the magnetic material in a saturated static magnetic field, in a direction perpendicular to the static magnetic field. The ΔH is calculated from the imaginary part $\mu''$ of the magnetic permeability measured under the latter condition. A small ferromagnetic resonance half-width ΔH indicates a small loss.

Therefore, according to the non-reciprocal circuit element of the present invention, the ferromagnetic resonance half-width ΔH of the magnetic plate is 4.8 kA/m or less, thereby decreasing the insertion loss.

According to the non-reciprocal circuit element of the present invention, the magnetic plate is preferably composed of garnet ferrite represented by the formula:

$$Y_{3-x}R_xFe_{5-y-z}M_yAl_zO_{12}$$

wherein the element R is at least one element selected from the group consisting of La, Ce, Pr, Nd, Pm, Sm, Eu, Gd, Tb, Dy, Ho, Er, Tm, Yb, and Lu, the element M is In or a combination of Ca and Sn or a combination of Ca and Zr, and the subscripts x, y, and z representing the stoichiometric ratio satisfy $0.3 \leqq x \leqq 1.5$, $0 \leqq y \leqq 0.6$, and $0 \leqq z \leqq 0.5$.

According to the non-reciprocal circuit element of the present invention, the magnetic plate is preferably composed of a garnet ferrite represented by the formula:

$$Y_{3-x}R_xFe_{a-y-z}M_yAl_zO_{12}$$

wherein the element R is at least one element selected from the group consisting of La, Ce, Pr, Nd, Pm, Sm, Eu, Gd, Tb, Dy, Ho, Er, Tm, Yb, and Lu, the element M is In or a combination of Ca and Sn or a combination of Ca and Zr, and the subscripts a, x, y, and z representing the stoichiometric ratio satisfy $4.75 \leqq a \leqq 4.95$, $0.3 \leqq x \leqq 1.5$, $0 \leqq y \leqq 0.6$, and $0 \leqq z \leqq 0.5$.

In both of the above formula, in particular, the element R is preferably Gd, and the element M is preferably In.

According to the non-reciprocal circuit element, the magnetic plate is composed of the garnet ferrite represented by the above formulas; therefore, the temperature coefficient of the saturation magnetization of the magnetic plate can be from −0.2%/° C. to −0.1%/° C.

According to the non-reciprocal circuit element according to the present invention, the horizontal length of an overlapped area between the first main segment functioning as an input and the second main segment functioning as an output is preferably 10% or more of the horizontal length of the main segments overlapping on the other face of the magnetic plate.

The horizontal length of the overlapped area of the first main segment functioning as an input and the second base segment functioning as an output in the intersection of both of the main segments is determined as described above. Accordingly, the capacitance value secured in the overlapped area of the main segments becomes larger and the inductance of the main segments can be small, thereby minimizing the shift of the inductance with change in temperature. Thus, the insertion loss of the non-reciprocal circuit element can be decreased.

According to the non-reciprocal circuit element of the present invention, each of the first main segment functioning as an input and the second main segment functioning as an output is preferably connected to matching capacitors and the third main segment is preferably connected to a matching capacitor and a terminator.

The non-reciprocal circuit element allows signals from the input to the output to pass without loss, but does not allow signals to pass in the opposite direction. Therefore, the non-reciprocal circuit element of the present invention is preferably used for a communication device such as a cellular phone.

A communication device of the present invention includes any one of the non-reciprocal circuit element descried above; a transmitting circuit connected to the first main segment functioning as an input of the non-reciprocal circuit element; and an aerial connected to the second main segment functioning as an output of the non-reciprocal circuit element.

The communication device includes the non-reciprocal circuit element with a reduced shift of the insertion loss with change in temperature, thereby suppressing the increase in the insertion loss and allowing stable communication.

DESCRIPTION OF THE PREFERRED EMBODIMENTS

Figure 1A:
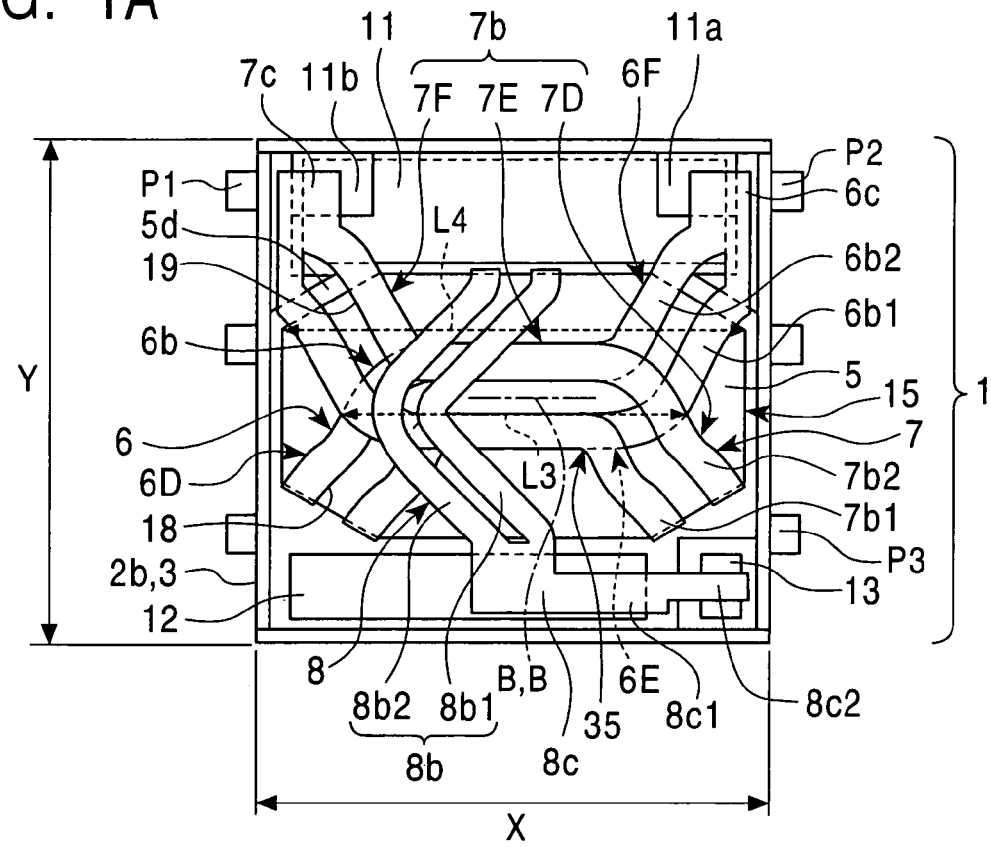
FIG. 1A is a plan view of an isolator wherein a part of the isolator is removed according to a first embodiment of the present invention.

The embodiments of the present invention will now be described with reference to the drawings.

First Embodiment

FIGS. 1A, 1B, 2, and 3 show a first embodiment wherein a non-reciprocal circuit element according to the present invention is used as an isolator.

An isolator 1 (i.e., non-reciprocal circuit element) of this embodiment includes a top yoke component 2*a* and a bottom yoke component 2*b* that form a box-shaped yoke 3. The box-shaped yoke 3 further includes a magnet 4 such as ferrite, a magnetic plate 5, line conductors 6, 7, and 8, a common electrode 10 that connects to the line conductors 6, 7, and 8, matching capacitor chips 11 and 12, and a terminator 13 (resistor) disposed around the magnetic plate 5.

The top yoke component 2*a* and the bottom yoke component 2*b* are composed of a ferromagnetic substance such as soft iron and form a box-shaped yoke 3, having a rectangular parallelepiped shape. A conductive layer such as Ag plating layer is preferably formed on the front faces and back-side faces of the yoke components 2*a* and 2*b*. The top yoke component 2*a*, which is U-shaped in side view, has dimensions appropriate for fitting into the bottom yoke component 2*b*, which is also U-shaped in side view, so that the top yoke component 2*a* and the bottom yoke component 2*b* can be joined at their openings to form an integrated single box serving as a magnetic closed circuit.

The shape of the yoke components 2*a* and 2*b* is not limited to the U-shape as described in this embodiment; the yoke components according to the present invention may have any shape that allows the box-shaped magnetic closed circuit to be formed.

The space formed by integrating the top yoke component 2*a* and the bottom yoke component 2*b* as described above (inner space of the box-shaped yoke 3) accommodates a magnetic assembly 15 that includes the magnetic plate 5, the three line conductors 6, 7, and 8, and the common electrode 10 that connects the conductor 6, 7, and 8. In this way, the isolator of the present embodiment includes the magnetic assembly 15.

Figure 2:
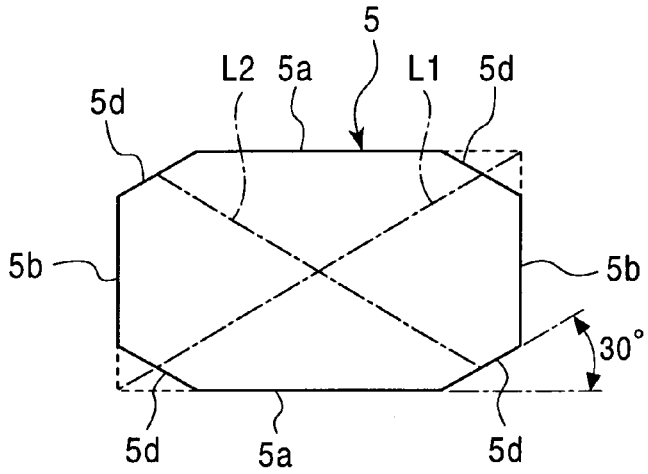
FIG. 2 is a plan view showing an example of a magnetic plate used in the isolator shown in FIGS. 1A and 1B.

The magnetic plate 5 is composed of a garnet ferrite including the compositions described later and may have any shape, such as round and polygonal shape, according to needs. The magnetic plate 5 is substantially rectangular (with horizontal long sides) in plan view, as shown in FIG. 2. In more detail, the magnetic plate 5 is substantially rectangular with two horizontal long sides 5*a* facing each other, two short sides 5*b* perpendicular to the long sides 5*a*, and four oblique sides 5*d* that connect the long sides 5*a* and the short sides 5*b*. The four oblique sides 5*d* are disposed at both ends of the long sides 5*a* and inclined to each of the long sides 5*a* by 150° (i.e., inclined to each of the extended lines of the long sides 5*a* by 30°). Accordingly, oblique sides 5*d* (oblique faces) that inclined to each of the long sides 5*a* by 150° (i.e., inclined to each of the short sides 5*b* by 120°) are formed at four corners in plan view of the magnetic plate 5.

The magnetic plate 5 is composed of the garnet ferrite essentially including Y (yttrium), element R, Fe (iron), element M, and O (oxygen), and in some cases further including Al (aluminum). The basic composition of the magnetic plate 5 is $Y_3Fe_5O_{12}$. In the magnetic plate 5, the element R substitutes for a part of the Y, and the element M and Al substitute for a part of the Fe. A temperature coefficient of the saturation magnetization of the magnetic plate 5 is from −0.2%/° C. to −0.1%/° C. in a temperature range from −35° C. to 85° C. Furthermore, a ferromagnetic resonance half-width ΔH of the magnetic plate 5 is preferably 4.8 kA/m or less, more preferably 2.4 kA/m or less. An example of the composition of the magnetic plate 5 includes $Y_{3-x}R_xFe_{5-y-z}M_yAl_zO_{12}$, wherein the element R is at least one element selected from the group consisting of La, Ce, Pr, Nd, Pm, Sm, Eu, Gd, Tb, Dy, Ho, Er, Tm, Yb, and Lu, the element M is composed of In or a combination of Ca and Sn or a combination of Ca and Zr, and subscripts x, y, and z representing the stoichiometric ratio are represented by $0.3 \leqq x \leqq 1.5$, $0 \leqq y \leqq 0.6$, and $0 \leqq z \leqq 0.5$.

According to this embodiment, an example of the composition of magnetic plate 5 may include $Y_{3-x}R_xFe_{a-y-z}M_yAl_zO_{12}$, wherein the element R is at least one element selected from the group consisting of La, Ce, Pr, Nd, Pm, Sm, Eu, Gd, Tb, Dy, Ho, Er, Tm, Yb, and Lu, the element M is composed of In or a combination of Ca and Sn or a combination of Ca and Zr, and subscripts a, x, y, and z representing the stoichiometric ratio are represented by $4.75 \leqq a \leqq 4.95$, $0.3 \leqq x \leqq 1.5$, $0 \leqq y \leqq 0.6$, and $0 \leqq z \leqq 0.5$.

In both of the above formula, in particular, the element R is preferably Gd, and the element M is preferably In.

In the formula, Y (yttrium) is an essential element forming the crystal of the garnet ferrite as in Fe (iron) and O (oxygen). The substitution of the element R for a part of Y allows the temperature coefficient of the saturation magnetization to increase.

The element R is added to substitute a part of Y, thereby increasing the temperature coefficient of the saturation magnetization in the garnet ferrite. In particular, the addition of Gd greatly increases the temperature coefficient. The element R, including Gd, shows magnetic moment due to the orbital moment of the electrons. The saturation magnetization in the element R rapidly increases in a range from absolute zero temperature to a room temperature. On the other hand, the magnetization in Fe gradually decreases as temperature increases. The interaction of the magnetic properties between the element R and Fe allows the temperature coefficient of the saturation magnetization in the garnet ferrite to be controlled. The content of Gd, i.e. the subscript x, is preferably from 0.3 to 1.5. The x of less than 0.3 provides the temperature coefficient of the saturation magnetization in the garnet ferrite of less than −0.2%/° C., whereas the x exceeding 1.5 provides the temperature coefficient of the saturation magnetization in the garnet ferrite of more than −0.1%/° C.

Iron (Fe) is an essential element forming the crystal of the garnet ferrite as in Y and O. The crystals of Fe include two electronic states, i.e., bivalence and trivalence, and Fe shows magnetic moment based on the spin quantum number. The saturation magnetization in Fe gradually decreases in a range from absolute zero temperature to the room temperature, and becomes zero at Curie point. As described above, the magnetization in the element R increases as temperature increases. The interaction of the magnetic properties between Fe and the element R allows the temperature coefficient of the saturation magnetization in the garnet ferrite to be controlled. The substitution of the element M and Al for a part of Fe allows the ferromagnetic resonance half-width ΔH to be decreased, thereby decreasing the insertion loss of the non-reciprocal circuit element. In the garnet ferrite, the stoichiometric ratio (i.e., the sum) of Fe, the element M, and Al is 5. As shown in the stoichiometric ratio a, i.e., the subscript a, in the above formula, the sum of Fe, the element M, and Al may be in the range from 4.75 to 4.95. If the stoichiometric ratio a is in the range from 4.75 to 4.95, the ferromagnetic resonance half-width ΔH of the garnet ferrite is 2.4 kA/m or less, thereby further decreasing the insertion loss of the non-reciprocal circuit element. If the Fe content is too small, that is, the stoichiometric ratio a including Fe is less than 4.75, the ΔH value is certainly deteriorated, that is, increased.

The element M is added to substitute a part of Fe, thereby decreasing the ferromagnetic resonance half-width ΔH of the garnet ferrite. When the temperature coefficient of the saturation magnetization is adjusted from −0.2 to −0.1%/° C. by controlling the content of the element R, the ferromagnetic resonance half-width ΔH may increase, thereby increasing the insertion loss. In that case, adding the element M allows the ferromagnetic resonance half-width ΔH to decrease. The content of the element M, i.e., the subscript y, in the formula is preferably from 0 to 0.6. The y exceeding 0.6 provides the temperature coefficient of the saturation magnetization of less than −0.2%/° C.

Furthermore, Al is added to substitute a part of Fe, thereby decreasing the saturation magnetization (4πMs) of the garnet ferrite. When the temperature coefficient of the saturation magnetization is adjusted from −0.2 to −0.1%/° C. by controlling the content of the element R, the ferromagnetic resonance half-width ΔH may increase, thereby increasing the insertion loss. In that case, adding the element M allows the ferromagnetic resonance half-width ΔH to decrease. On the other hand, the addition of the element M increases the saturation magnetization (4πMs). Accordingly, the addition of Al is effective in order to decrease the saturation magnetization (4πMs). The content of Al, i.e., the subscript z in the formula is preferably from 0 to 0.5. The z exceeding 0.5 relatively decreases the content of Fe, thereby decreasing the saturation magnetization.

Oxygen (O) is an essential element forming the crystal of the garnet ferrite as in Y and Fe. The content of the O, i.e., the stoichiometric ratio of O, is preferably 12, based on the basic composition of the garnet ferrite ($Y_3Fe_5O_{12}$).

A method for producing the magnetic plate 5 will now be described. First, oxide powders including the elements of the desired composition are prepared. Then the powders are mixed such that the elements of the mixed powder have the desired composition ratio.

In order to produce a garnet ferrite having a formula Y—Gd—Fe—Al—M—O, for example, $Y_2O_3$, $Gd_2O_3$, $Fe_2O_3$, $MO_b$ (such as $In_2O_3$), and $Al_2O_3$ powder are prepared for the materials.

Then each powder is weighed so as to achieve the desired composition ratio. In the case where the materials are not powdery but granular or chunky, these materials are mixed and then the materials are further crushed and mixed with an apparatus, for example, a ball mill or an attritor. The mixture is dried and calcinated at 1,000° C. to 1,200° C. in air or in oxygen for a predetermined period, for example, a few hours to produce the calcinated powder (calcinated material). The calcinated material is crushed with, for example, a ball mill or an attritor to form the powder.

The resultant calcinated powder is classified so as to include a predetermined range of the particle size and mixed with binder to form a desired shape. The mixture is compacted under the pressure of about 1 t/cm$^2$ to form the desired shape, for example, a disc, a plate, or a rectangular column. The resultant compact is sintered at about 1,350° C. to 1,500° C. The compact may have the near net shape. In that case, the magnetic plate 5 having the desired shape can be produced by cutting the sintered compact having the near net shape.

The magnet 4 disposed at the opposite side of the magnetic plate 5 applies a bias magnetic field to the magnetic plate 5. A temperature coefficient of the residual magnetization of the magnet 4 is preferably from −0.20%/° C. to −0.15%/° C. in a temperature range from −35° C. to 85° C. An example of the magnet includes a ferrite magnet.

Figure 3:
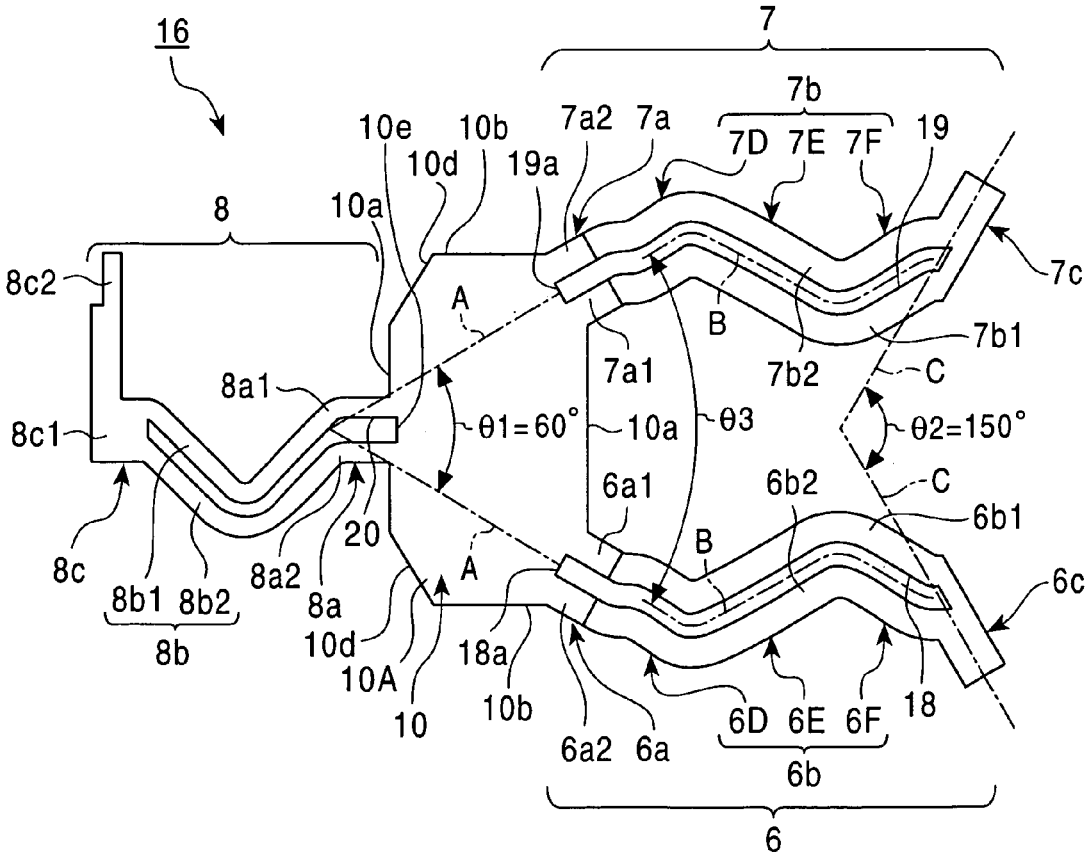
FIG. 3 is a laid out flat view of an electrode unit used in the isolator shown in FIGS. 1A and 1B.

Referring to the laid out flat view in FIG. 3, the three line conductors 6, 7, and 8 and the common electrode 10 are integrated to form an electrode unit 16. The common electrode 10 includes a body 10A which is a metallic plate geometrically similar to that of the magnetic plate 5 in plan view. In plan view, the body 10A has a substantially rectangular shape with two long sides 10*a* facing each other, two short sides 10*b* perpendicular to the long sides 10*a*, and four oblique sides 10*d* disposed at both ends of the long sides 10*a* and inclined to each of the long sides 10*a* by 150° and inclined to each of the short sides 10*b* by 120°.

The first line conductor 6 and the second line conductor 7 extend from the common electrode 10. More specifically, the conductor 6 extends from one end of a first long side 10*a* of the common electrode 10 and the conductor 7 extends from the other end of the first long side 10*a*. The first line conductor 6 consists of a first base segment 6*a*, a first main segment 6*b* (main segment), and a first terminal segment 6*c*. The second line conductor 7 consists of a second base segment 7*a*, a second main segment 7*b* (main segment), and a second terminal segment 7*c*.

Referring to FIG. 3, an angle θ1 formed by the central axes A of the base segments 6*a* and 7*a* is about 60°.

The first main segment 6*b* functions as an input and the second main segment 7*b* functions as an output.

The first main segment 6*b* has a wave shape or zigzag shape, and consists of a base-end portion 6D, a terminal-end portion 6F, and a central portion 6E disposed therebetween. The second main segment 7*b* has the same shape as in the first main segment 6*b*, and consists of a base-end portion 7D, a terminal-end portion 7F, and a central portion 7E disposed therebetween. The shapes of the first main segment 6*b* and the second main segment 7*b* allow the length of the segments to increase, thereby increasing an inductance. Accordingly, the non-reciprocal circuit element is adaptable to lower frequency while achieving reduction in size.

Referring to FIG. 3, an angle θ3 formed by the central axes B of the base-end portions 6D and 7D is the same as the angle θ1 or larger than the angle θ1. That is, the angle θ3 is determined such that the base-end portions 6D and 7D gradually diverge.

The central portions 6E and 7E are formed such that the central axes B of the central portions 6E and 7E gradually converge.

An angle θ3 formed by the central axes B of the terminal-end portions 6F and 7F is larger than the angle θ1. That is, the angle θ3 is determined such that the terminal-end portions 6F and 7F gradually diverge.

Furthermore, an angle θ2 formed by the central axes C of the terminal segments 6*c* and 7*c* is about 150° or more. That is, the angle θ2 is determined such that the terminal segments 6*c* and 7*c* gradually diverge.

The first line conductor 6 has a slit 18 formed in the lateral center thereof so that the main segment 6*b* has two divisions 6*b*1 and 6*b*2. Specifically, the slit 18 extends from the periphery of the common electrode 10 and is disposed in the lateral center of the first base segment 6*a*, the first main segment 6*b*, and the first terminal segment 6*c*. The base segment 6*a* also has two divisions 6*a*1 and 6*a*2.

As in the slit 18, the second line conductor 7 has a slit 19 formed in the lateral center thereof so that the main segment 7*b* has two divisions 7*b*1 and 7*b*2. The base segment 7*a* also has two divisions 7*a*1 and 7*a*2.

One end of the slit 18 adjacent to the common electrode 10 extends through the base segment 6*a* and is disposed at a position slightly inside of the periphery of the common electrode 10. Specifically, a recess 18*a* is formed at the end of the slit 18 adjacent to the common electrode 10. The recess 18*a* allows the length of the first line conductor 6 to be slightly longer. One end of the slit 19 adjacent to the common electrode 10 also extends through the base segment 7*a* and is disposed at a position slightly inside of the periphery of the common electrode 10. Specifically, a recess 19*a* is formed at the end of the slit 19 adjacent to the common electrode 10. The recess 19*a* allows the length of the second line conductor 7 to be slightly longer. The recess 18*a* and the recess 19*a* are formed if necessary.

The common electrode 10 has the third line conductor 8 extending from the center of a second long side 10*a* thereof. The third line conductor 8 includes a third base segment 8*a*, a third main segment 8*b* (main segment), and a third terminal segment 8*c* projected from the common electrode 10. The third base segment 8*a* has two strip-shaped divisions 8*a*1 and 8*a*2 separated by a slit 20 formed therebetween. The divisions 8*a*1 and 8*a*2 extend from the center of the second long side 10*a* of the common electrode 10 and are disposed substantially perpendicular to the long side 10*a*.

The third main segment 8*b* has an L shape in plan view. Specifically, the third main segment 8*b* includes a division 8*b*1 having an L shape in plan view connecting to the division 8*a*1, and a division 8*b*2 having an L shape in plan view connecting to the division 8*a*2. The bended shape of the third main segment 8*b* allows the substantial length of the line conductor to increase, thereby increasing the inductance. Accordingly, the non-reciprocal circuit element is adaptable to lower frequency while achieving reduction in size.

Furthermore, the tips of these divisions 8*b*1 and 8*b*2 are integrated into the third L-shaped terminal segment 8*c*. This third terminal segment 8*c* includes a first connection 8*c*1 and a second connection 8*c*2. The first connection 8*c*1 is formed by combining the divisions 8*b*1 and 8*b*2 and extends in the same direction of the divisions 8*a*1 and 8*a*2. The second connection 8*c*2 extends in the direction substantially perpendicular to the first connection 8*c*1.

In the common electrode 10 adjacent to the second long side 10*a* of, a recess 10*e* is formed between the divisions 8*a*1 and 8*a*2 of the third line conductor 8. The recess 10*a* is formed such that a part of the long side 10*a* of the common electrode 10 is cut out. The recess 10*e* allows the length of the third line conductor 8 to be slightly longer. The recess 10*e* is also formed as in the recesses 18*a* and 19*a* if necessary.

The electrode unit 16 with the structure described above has the body 10A of the common electrode 10 disposed on the lower surface (one surface) of the magnetic plate 5. The common electrode 10 further has the first line conductor 6, the second line conductor 7, and the third conductor 8 folded on the upper surface (the other surface) of the magnetic plate 5 and the entire common electrode 10 is mounted on the magnetic plate 5. In this manner, the common electrode 10, along with the magnetic plate 5, forms the magnetic assembly 15.

Specifically, the divisions 6*a*1 and 6*a*2 of the first line conductor 6 are folded along the edge of one oblique side 5*d* of the magnetic plate 5, the divisions 7*a*1 and 7*a*2 of the second line conductor 7 are folded along the edge of another oblique side 5*d* of the magnetic plate 5, and the divisions 8*a*1 and 8*a*2 of the third line conductor 8 are folded along the edge of a long side 5*a* of the magnetic plate 5. Furthermore, the main segment 6*b* of the first line conductor 6 is disposed along the upper surface (the other surface) of the magnetic plate 5, the main segment 7*b* of the second line conductor 7 is disposed along the upper surface (the other surface) of the magnetic plate 5, and the main segment 8*b* of the third line conductor 8 is disposed along the center of the upper surface of the magnetic plate 5. As described above, the magnetic plate 5 is installed in the electrode unit 16 to form the magnetic assembly 15.

Figure 1B:
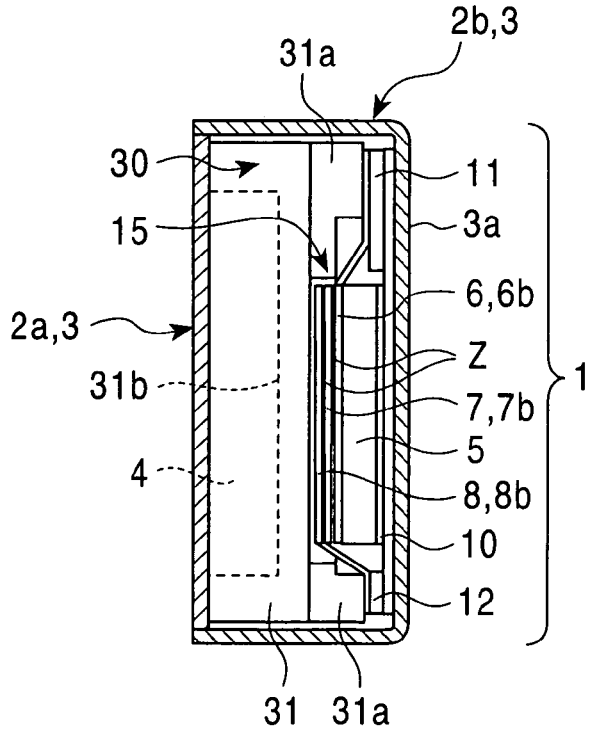
FIG. 1B is a sectional view of the same isolator shown in FIG. 1A.

As described above, when the first main segment 6*b* and the second main segment 7*b* are disposed along the upper surface (the other surface) of the magnetic plate 5, the main segments 6*b* and 7*b* intersect on the surface of the magnetic plate 5. FIGS. 1A and 1B show the case where the central portions 6E and 7E are overlapped.

Referring to FIGS. 1A and 1B, the first main segment 6*b*, which functions as an input, is disposed adjacent to the magnetic plate 5, and the second main segment 7*b*, which functions as an output, is disposed adjacent to the first main segment 6*b*. Specifically, the first main segment 6*b* is directly in contact with the upper surface (the other surface) of the magnetic plate 5. In this case, the difference between inductances of the first main segment 6*b* can be decreased, because the first main segment 6*b* and the magnetic plate 5 do not have a gap therebetween. Accordingly, this structure allows the difference between the input impedances of the isolator 1 to be suppressed.

As shown in FIG. 1B, insulating sheets Z are preferably disposed between the second main segment 7*b*, which functions as an output, and the first main segment 6*b*, and between the third main segment 8*b* and the second main segment 7*b* so that the main segments 6*b*, 7*b*, and 8*b* are electrically insulated from one another.

The second main segment 7*b* is overlapped on the first main segment 6*b*. Accordingly, the second main segment 7*b* is close to the magnetic plate 5. In this structure, the inductance of the second main segment 7*b* can be increased, thereby achieving the reduction in size of the isolator 1. Furthermore, this structure allows the difference between the inductances to decrease. Accordingly, the difference between the output impedances can be suppressed.

Referring to FIG. 1A, an intersection 35 is the overlapped area between the first main segment 6*b* and the second main segment 7*b*. A length L3 is defined as the horizontal length of the main segments 6*b* and 7*b* in the intersection 35. As shown in FIG. 1A, a length L4 is defined as the horizontal length wherein the main segments 6*b* and 7*b* are overlapped on the upper surface (the other surface) of the magnetic plate 5. In more detail, the length L4 is defined as the horizontal length between two intersecting points between the magnetic plate 5 and the main segments 6*b* and 7*b*, that is, the two intersecting points farthest away from each other. The length L3 is 10% or more, preferably 20% or more, of the length L4. FIG. 1A shows the case where the length L3 of the intersection 35 is about 75% of the length L4.

The upper limit of the length L3 of the overlapped area can be 100% of the length L4 by changing, for example, the shape of the first line conductor 6 and the second line conductor 7. For example, the angle θ1, which is formed by central axes A of the first base segment 6*a* and the second first base segment 7*a*, or the angle θ3, which is formed by central axes B of the first main segment 6*b* and the second main segment 7*b* may be changed.

If the overlapped area between the first main segment 6*b* and the second main segment 7*b* intersects, the intersection angle is preferably 30° or less, more preferably, 15° or less.

Most preferably, in the overlapped area of the main segments 6*b* and 7*b*, the first main segment 6*b* and the second main segment 7*b* do not intersect but are substantially parallel.

FIG. 1A shows a case where the central axes B of the central portions 6E and 7E are parallel.

As described above, the length L3 is 10% or more of the length L4. (The length L3 is defined as the horizontal length of the main segments 6*b* and 7*b* in the intersection 35. The length L4 is defined as the horizontal length wherein the main segments 6*b* and 7*b* are overlapped on the upper surface (the other surface) of the magnetic plate 5.) In this case, as the length L3 becomes longer, the capacitance value ensured in the overlapped area of the first main segment 6*b* and the second main segment 7*b* becomes larger. Accordingly, the inductance of the main segments 6*b* and 7*b* can be decreased, i.e., the length of the main segments 6*b* and 7*b* can be decreased, thereby achieving the reduction in size of the isolator 1.

Figure 4:
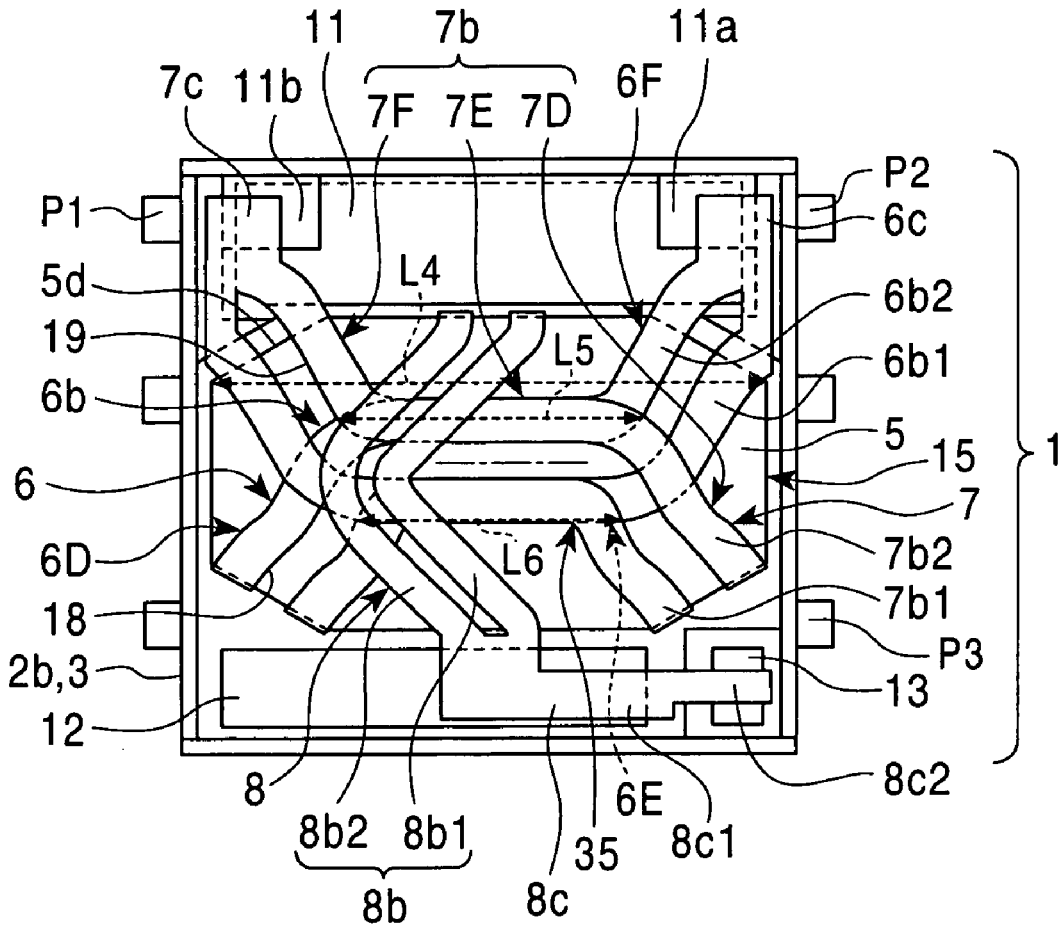
FIG. 4 is a plan view of an isolator wherein a part of the isolator is removed according to the first embodiment of the present invention.

When each of the first line conductor 6 and the second line conductor 7 includes two divisions as described above, the length of the overlapped area of the first main segment 6*b* and second main segment 7*b* in the intersection 35 may be defined as follows: as shown in FIG. 4, a length L5, i.e., a horizontal length of the overlapped area between one division 6*b*1 of the first main segment 6*b* and one division 7*b*1 of the second main segment 7*b*, or a length L6, i.e., a horizontal length of the overlapped area between the other division 6b2 of the first main segment 6b and the other division 7b2 of the second main segment 7b. In this case, the lengths L5 and L6 (the lengths of the overlapped area of the divisions) are preferably 10% or more of the length L4 (the length wherein the base segments are overlapped on the upper surface, i.e., the other surface, of the magnetic plate 5) because of the reason described above.

When each of the first line conductor 6 and the second line conductor 7 includes two divisions as described above, the intersection angle of the overlapped area of the first main segment 6b and second main segment 7b in the intersection 35 may be defined as follows: the intersection angle in the overlapped area between one division 6b1 of the first main segment 6b and one division 7b1 of the second main segment 7b, or an intersection angle in the overlapped area between the other division 6b2 of the first main segment 6b and the other division 7b2 of the second main segment 7b. In this case, the intersection angle is preferably 30° or less because of the reason described above.

The magnetic assembly 15 is disposed in the bottom center of the bottom yoke component 2b. The plate matching capacitor chips 11 and 12, elongated in plan view and about half as thick as the magnetic plate 5, are also disposed on the bottom yoke component 2b so as to interpose the magnetic assembly 15 therebetween. The matching capacitor chip 12 has the terminator 13 (resistor) mounted on one end thereof.

The terminal segment 6c of the first line conductor 6 is electrically connected to a capacitor electrode 11a formed at one end of the matching capacitor chip 11, the terminal segment 7c of the second line conductor 7 is electrically connected to a capacitor electrode 11b formed at the other end of the matching capacitor chip 11, and the terminal segment 8c of the third line conductor 8 is electrically connected to the matching capacitor chip 12 and the terminator 13, whereby the matching capacitor chips 11 and 12 and the terminator 13 are connected to the magnetic assembly 15. A non-reciprocal circuit element with the structure of this embodiment functions as a circulator when the terminator 13 is disconnected.

The end of the matching capacitor chip 11 to which the terminal segment 7c is connected functions as a first port P1 of the non-reciprocal circuit element 1, the end of the matching capacitor chip 11 to which the terminal segment 6c is connected functions as a second port P2 of the non-reciprocal circuit element 1, and the end of the terminator 13 to which the terminal segment 8c is connected functions as a third port P3 of the isolator 1.

The magnetic assembly 15, when placed in the space between the bottom yoke component 2b and the top yoke component 2a, occupies about half the space. As shown in FIG. 1B, a spacer 30 is disposed in the space extending from the magnetic assembly 15 to the top yoke component 2a. The magnet 4 is also mounted on the spacer 30 disposed in the foregoing space.

The spacer 30 includes a base 31 having rectangular plate shape in plan view and being small enough to fit into the interior of the top yoke component 2a and legs 31a formed at four corners on the lower surface of the base 31. The spacer 30 further includes a round holding recess 31b on the opposite surface of the base 31, i.e., the upper surface which is away from the surface having the legs 31a, and a rectangular hole (not shown in the figure) on the surface away from the holding recess 31b such that the hole passes through the base 31.

The disc magnet 4 is fitted into the holding recess 31b. The four legs 31a of the spacer 30 including the magnet 4 press the matching capacitor chips 11 and 12, the terminal segments 6c and 7c connected to the matching capacitor chips 11 and 12, the terminator 13, and the leading end of the terminal segment 8c connected to the terminator 13 down the bottom side of the bottom yoke component 2b. The bottom portion of the spacer 30 presses the magnetic assembly 15 down the bottom side of the bottom yoke component 2b. Thus the magnet 4 is disposed between the yoke components 2a and 2b.

According to the above isolator 1, the temperature coefficient of the saturation magnetization of the magnetic plate 5 is from −0.2%/° C. to −0.1%/° C. This temperature coefficient of the saturation magnetization of the magnetic plate 5 is larger than that of a typical YIG ferrite, and close to the temperature coefficient of the residual magnetization of the magnet 4 (i.e., from −0.20%/° C. to −0.15%/° C. in a temperature range from −35° C. to 85° C.). Accordingly, the ratio of the residual magnetization of the magnet 4 to the saturation magnetization of the magnetic plate 5 becomes substantially constant regardless of temperature decrease. Therefore, the inductances of the main segments 6b and 7b become constant, and the center frequency of the insertion loss does not shift from the preset value, thereby preventing the insertion loss of the isolator 1 from increasing.

According to the above isolator 1, the ferromagnetic resonance half-width ΔH of the magnetic plate 5 is 4.8 kA/m or less, thereby decreasing the insertion loss.

Furthermore, according to the isolator 1, the horizontal length of the intersection of the main segments 6b and 7b is 10% or more of the horizontal length wherein the main segments are overlapped on the other surface of the magnetic plate 5. Accordingly, the capacitance value ensured in the overlapped area of the main segments 6b and 7b becomes larger and the inductance of the main segments 6b and 7b can be decreased, thereby minimizing the shift of the inductance with change in temperature. Thus, the insertion loss of the isolator 1 can be decreased.

Figure 5A:
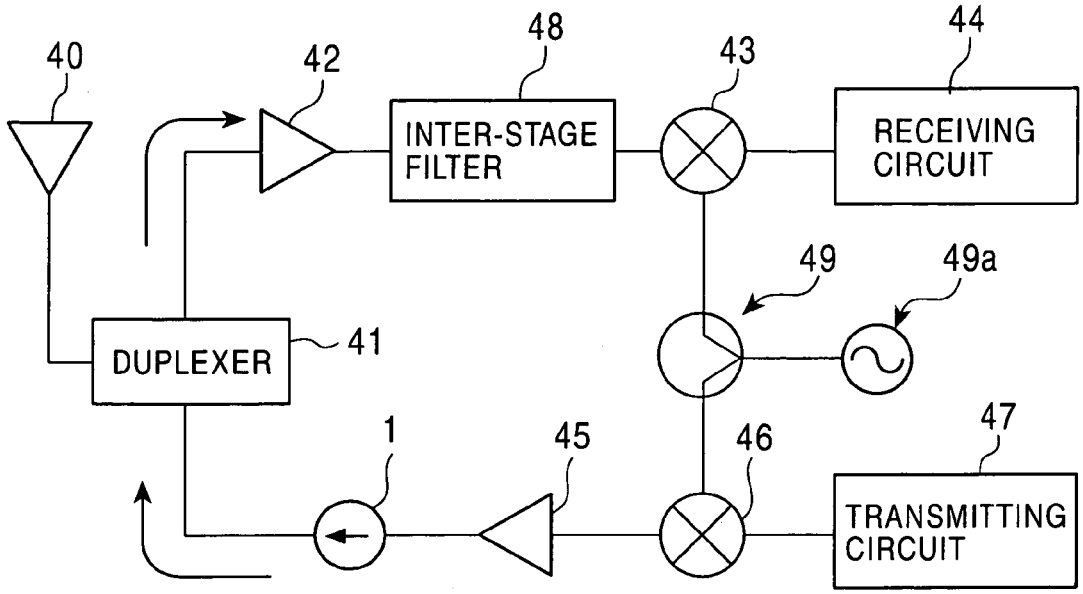
FIG. 5A is an example of a circuit diagram provided with an isolator according to the first embodiment of the present invention.

FIG. 5A is an example of a circuit of a cellular phone (communication device) using the isolator 1 described in the above the embodiment. In this circuit, a duplexer 41 is connected to an aerial 40; a receiving circuit 44 (IF circuit) is connected to an output of the duplexer 41 via a low-noise amplifier 42, an inter-stage filter 48, and a selective circuit 43 (mixer); a transmitting circuit 47 (IF circuit) is connected to an input of the duplexer 41 via the isolator 1 described in the above embodiment, a power amplifier 45, and a selective circuit 46 (mixer); and a local oscillator 49a is connected to the selective circuits 43 and 46 (mixers) via a distributing transformer 49. According to the isolator 1, the first main segment 6b functioning as an input is connected toward the transmitting circuit 47 (IF circuit), and the second main segment 7b functioning as an output is connected toward the aerial 40.

Referring again to FIG. 5A, the isolator 1 described above, which is used in a circuit of a cellular phone, allows signals from the isolator 1 to the duplexer 41 to pass at low insertion loss, but causes high insertion loss with signals from the duplexer 41 to the isolator 1 to block such signals in that direction. Thus, the isolator 1 prevents undesired signals such as noise in the power amplifier 45 from entering the low-noise amplifier 42 in the reverse direction.

Furthermore, the cellular phone includes the above isolator 1 with a small insertion loss. Accordingly, the attenuation of signals is prevented between the transmitting circuit 47 (IF circuit) and aerial 40, thereby improving the communication performance of the cellular phone.

Figure 5B:
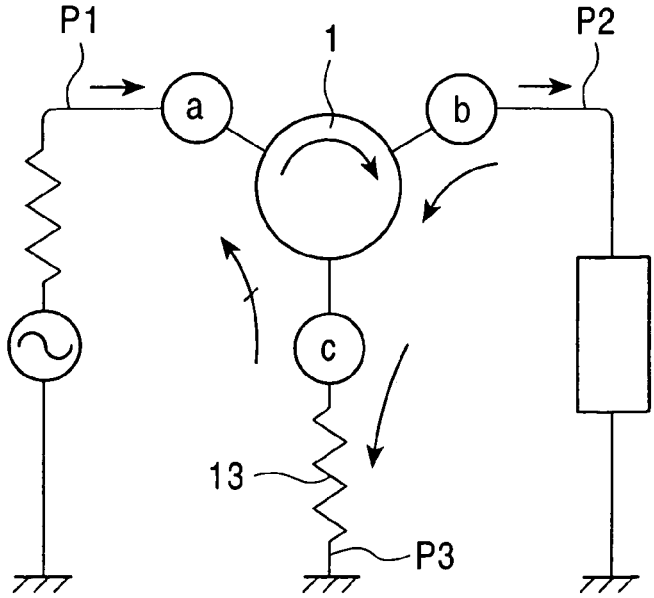
FIG. 5B is a diagram illustrating the operating principle of the isolator shown in FIG. 5A.

FIG. 5B illustrates the operating principle of the isolator 1 shown in FIGS. 1A, 1B, 2, 3, and 4. The isolator 1 in the circuit shown in FIG. 5B passes signals from a first port P1 (denoted by symbol a) to a second port P2 (denoted by symbol b), but attenuates signals from the second port P2 (denoted by symbol b) to a third port P3 (denoted by symbol c) by absorbing the signals into the terminator 13 (resistor) to block signals from the third port P3 (denoted by symbol c) directly connected to the terminator 13 to the first port P1 (denoted by symbol a).

As described above with reference to FIG. 5B, the isolator 1 functions as a unidirectional-flow signal controller when incorporated in the circuit shown in FIG. 5A.

Figure 6:
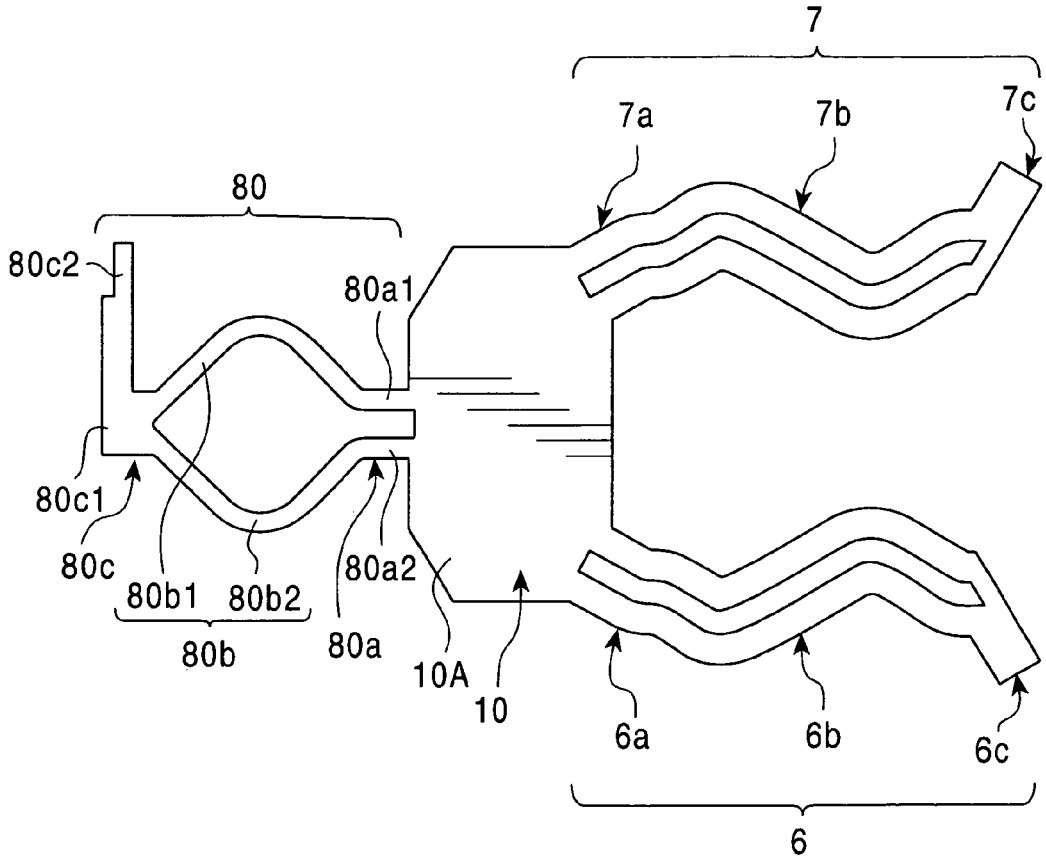
FIG. 6 is a laid out flat view of a second example of an electrode unit of the isolator according to the first embodiment of the present invention.
Figure 7:
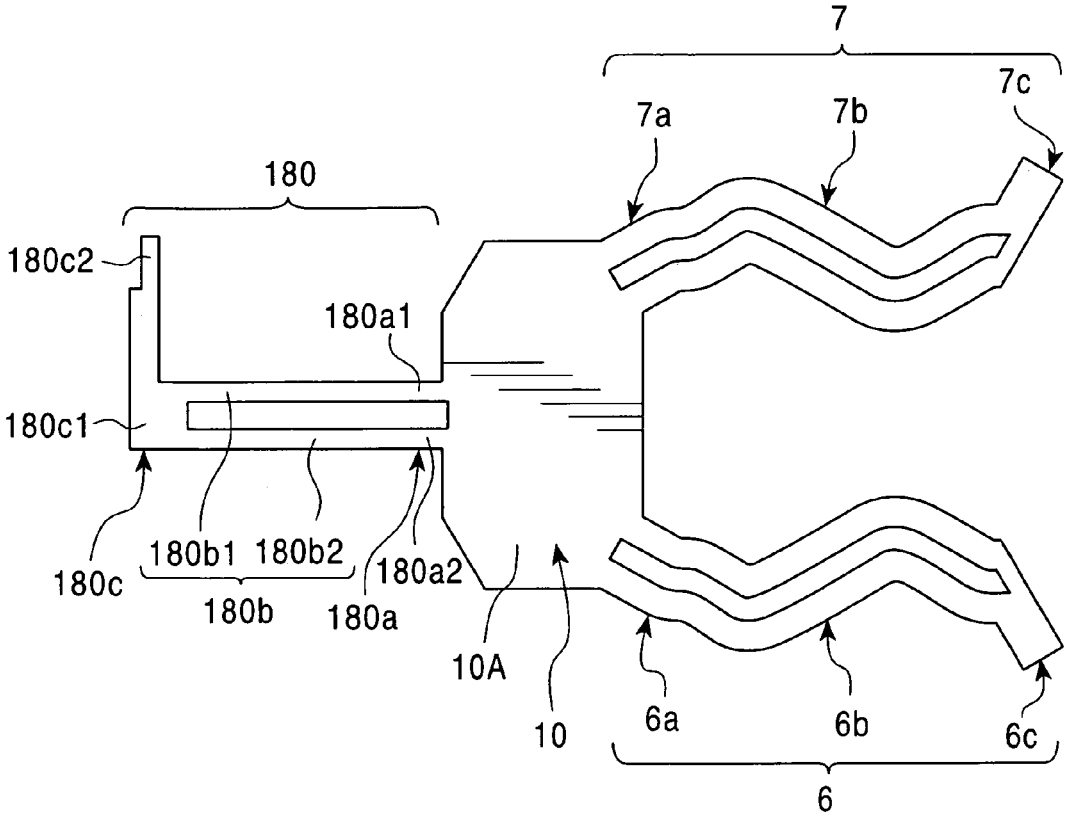
FIG. 7 is a laid out flat view of a third example of an electrode unit of the isolator according to the first embodiment of the present invention.

According to the isolator in the above embodiment, although the third line conductor 8 of the electrode unit 16 forming the magnetic assembly 15 has a shape shown in FIG. 3, the third line conductor 8 may have a shape shown in FIG. 6 or FIG. 7.

The difference between the third line conductor 80 in FIG. 6 and the third line conductor 8 in FIG. 3 is that divisions 80*b*1 and 80*b*2 extending from divisions 80*a*1 and 80*a*2 in FIG. 6 are not parallel. In more detail, the divisions 80*b*1 and 80*b*2 form a main segment 80*b* having a diamond shape such that both of the center of the divisions 80*b*1 and 80*b*2 are separated.

In the third line conductor 180 in FIG. 7, divisions 180*a*1 and 180*a*2 are straight lines in plan view. In addition, straight divisions 180*b*1 and 180*b*2 form a main segment 180*b*. Thus, the difference between the third line conductor 180 in FIG. 7 and the third line conductor 8 in FIG. 3 is that divisions of the third line conductor 180 are straight lines in plan view. This shape facilitates the third line conductor 180 to be bent to the magnetic plate 5.

Second Embodiment

Figure 8:
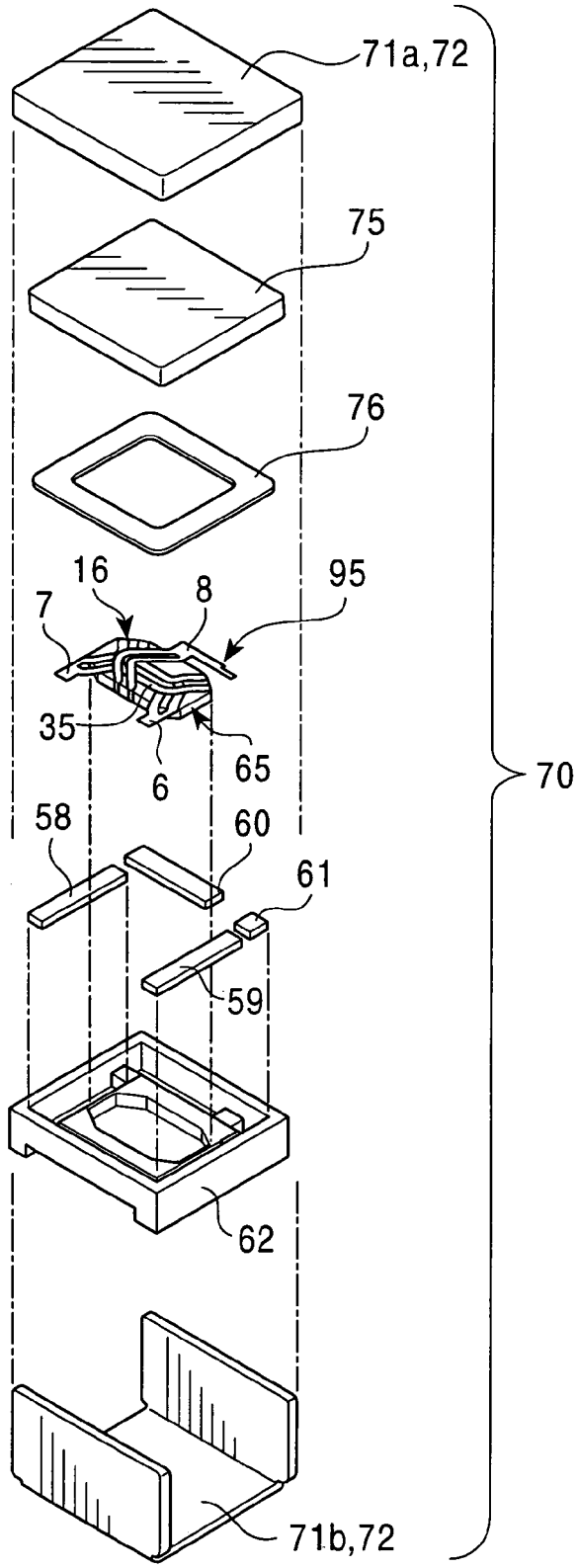
FIG. 8 is an exploded perspective view of an isolator according to a second embodiment of the present invention.

FIG. 8 shows a second embodiment wherein a non-reciprocal circuit element according to the present invention is used as an isolator. According to an isolator 70 of the second embodiment, the inner space of a box-shaped yoke 72 composed of a top yoke component 71*a* and a bottom yoke component 71*b*, i.e., the space between the top yoke component 71*a* and the bottom yoke component 71*b*, accommodates a magnet 75 composed of a rectangular plate permanent magnet, a spacer 76, a magnetic assembly 95, matching capacitor chips 58, 59, and 60, a terminator 61 (resistor), and a resinous case 62 for accommodating the above parts.

An electrode unit 16 as in the first embodiment is folded around a magnetic plate 65 having a substantially rectangular shape in plan view to form the magnetic assembly 95. The magnetic plate 65 has a shape almost the same as the magnetic plate 5 having horizontal long sides in the first embodiment, but has a rectangular shape close to a square.

In the electrode unit 16 folded around the magnetic plate 65, the terminal segment of the first line conductor 6 is electrically connected to a capacitor electrode (not shown in the figure) formed at one end of the matching capacitor chip 59, the terminal segment of the second line conductor 7 is electrically connected to a capacitor electrode (not shown in the figure) formed at the other end of the matching capacitor chip 58, and the terminal segment of the third central conductor 8 is electrically connected to the matching capacitor chip 60 and the terminator 61, whereby the matching capacitor chips 58, 59, and 60 and the terminator 61 are connected to the magnetic assembly 65.

The isolator 70 shown in FIG. 7 also functions as a unidirectional-flow signal controller as in the isolator 1 in the first embodiment.

Third Embodiment

Figure 9:
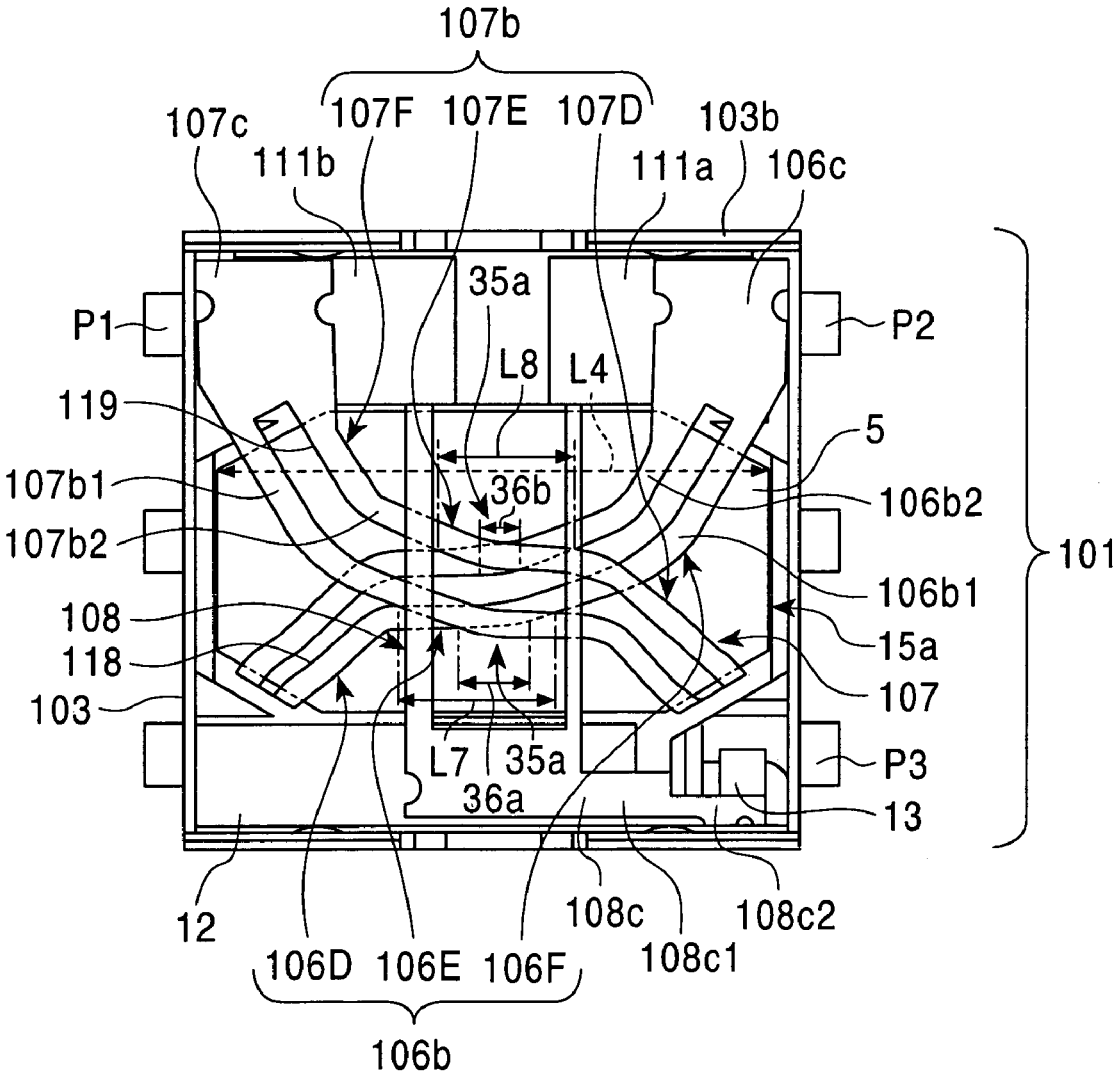
FIG. 9 is a plan view of an isolator wherein a part of the isolator is removed according to a third embodiment of the present invention.

FIG. 9 shows a third embodiment wherein a non-reciprocal circuit element according to the present invention is used as an isolator.

The difference between an isolator 101 of the third embodiment and the isolator 1 of the first embodiment shown in FIGS. 1A, 1B, 2, 3, and 4, is that the electrode unit forming the magnetic assembly has a different shape, and the first line conductor and the second line conductor are connected different capacitor chips.

Figure 10:
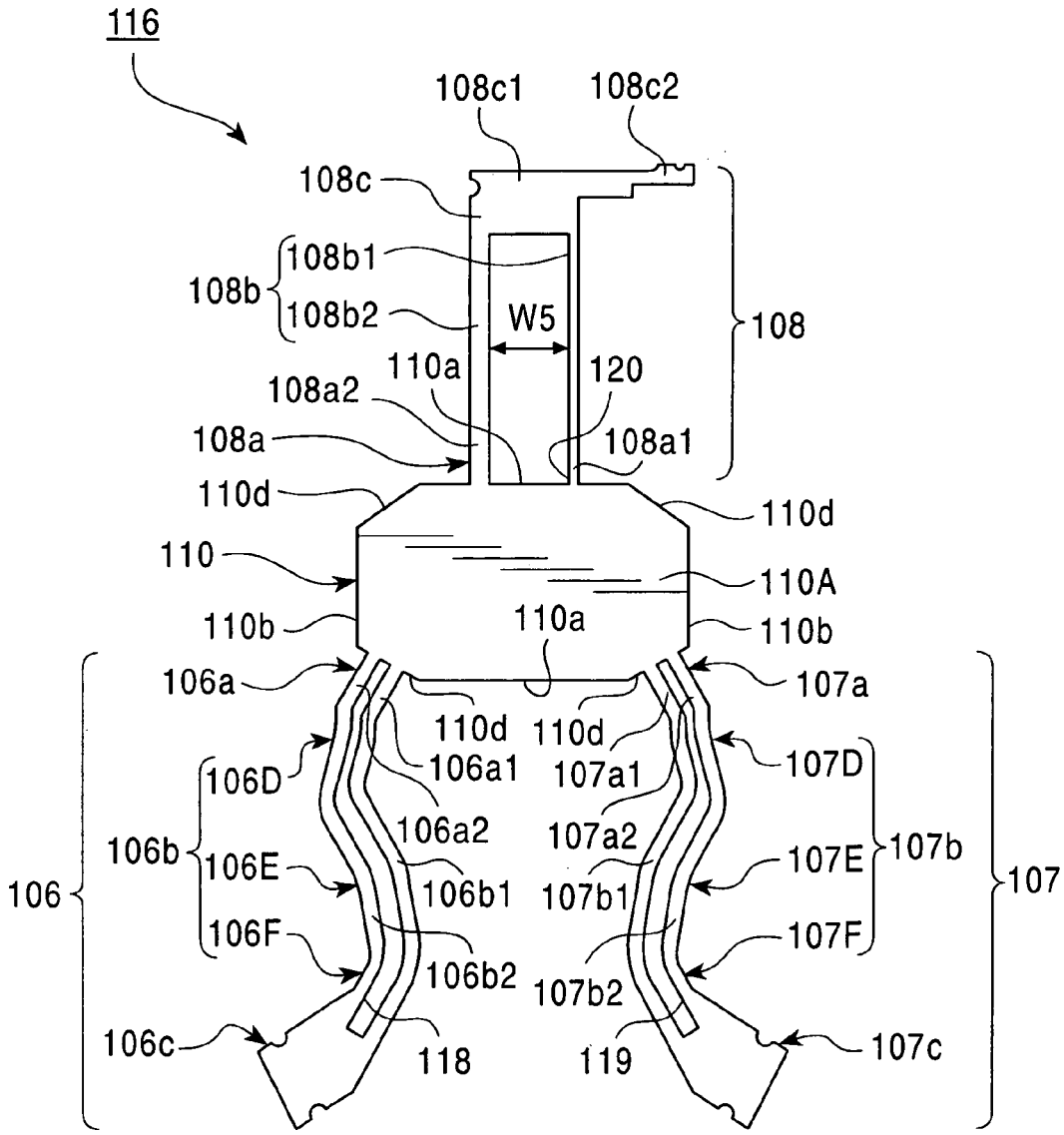
FIG. 10 is a laid out flat view of an electrode unit used in the isolator shown in FIG. 9.

FIG. 10 is a laid out flat view of an electrode unit 116 of a magnetic assembly 15*a* used in the isolator 101 of the present embodiment.

Three line conductors 106, 107, and 108 and a common electrode 110 are integrated to form the electrode unit 116.

The common electrode 110 includes a body 110A which is a metallic plate geometrically similar to that of the magnetic plate 5 in plan view. In plan view, the body 110A has a substantially rectangular shape with two long sides 110*a* facing each other, two short sides 110*b* perpendicular to the long sides 110*a*, and four oblique sides 110*d* disposed at both ends of the long sides 110*a* and inclined to each of the long sides 110*a* by 150° and inclined to each of the short sides 110*b* by 120°.

The first line conductor 106 and the second line conductor 107 extend from a first long side 110*a* of the common electrode 110. More specifically, the conductor 106 extends from a first oblique side 110*d* formed at one end of the first long side 110*a* and the conductor 107 extends from a second oblique side 110*d* formed at the other end of the first long side 110*a*.

The first line conductor 106 consists of a first base segment 106*a*, a first main segment 106*b*, and a first terminal segment 106*c*. The second line conductor 107 consists of a second base segment 107*a*, a second main segment 107*b*, and a second terminal segment 107*c*.

The first main segment 106*b* has a wave shape or zigzag shape, and consists of a base-end portion 106D, a terminal-end portion 106F, and a central portion 106E disposed therebetween. The main difference between the first main segment 106*b* and the first main segment 6*b* of the first embodiment is that the central portion 106E is not straight but forms an obtuse angle in plan view.

The second main segment 107*b* has the same shape as in the first main segment 106*b*, and consists of a base-end portion 107D, a terminal-end portion 107F, and a central portion 107E disposed therebetween.

As in the first embodiment, the first line conductor 106 has a slit 118 formed in the lateral center thereof so that the main segment 106*b* has two divisions 106*b*1 and 106*b*2. The base segment 106*a* also has two divisions 106*a*1 and 106*a*2.

As in the slit 118, the second line conductor 107 has a slit 119 formed in the lateral center thereof so that the main segment 107*b* has two divisions 107*b*1 and 107*b*2. The base segment 107*a* also has two divisions 107*a*1 and 107*a*2.

The common electrode 110 has the third line conductor 108 extending from the center of a second other long side 110*a* thereof. The third line conductor 108 includes a third base segment 108*a*, a third main segment 108*b*, and a third terminal segment 108*c* projected from the common electrode 110. The third base segment 108*a* has two strip-shaped divisions 108*a*1 and 108*a*2 separated by a slit 120 formed therebetween. The divisions 108*a*1 and 108*a*2 extend from the center of the second long side 110*a* of the common electrode 110 and are disposed substantially perpendicular to the long side 110*a*. As shown in FIG. 10, the division 108*a*2 has a width larger than the width of the division 108*a*1.

The third main segment 108*b* has a division 108*b*1 connecting to the division 108*a*1, and a division 108*b*2 connecting to the division 108*a*2. The two divisions 108*b*1 and 108*b*2 are separated by the slit 120 formed therebetween. The main difference between the third main segment 108*b* and the third main segment 8*b* of the first embodiment is that the divisions 108*b*1 and 108*b*2 have straight shapes in plan view, and the division 108*b*2 has a width larger than the width of the division 108*b*1.

Furthermore, the tips of these divisions 108*b*1 and 108*b*2 are integrated into the third terminal segment 108*c* having an L shape. This third terminal segment 108*c* includes a first connection 108*c*1 and a second connection 108*c*2. The first connection 108*c*1 is formed by integrated by the divisions 108*b*1 and 108*b*2 and extends in the same direction of the divisions 108*a*1 and 108*a*2. The second connection 108*c*2 extends in the direction substantially perpendicular to the first connection 108*c*1.

As described above, the two divisions of the third main segment 108*b* have straight shapes in plan view. This structure prevents the position of the third line conductor 108 from being shifted, when the magnetic assembly 15*a* is assembled by folding the third line conductor 108 around the magnetic plate 5.

When the third main segment 108*b* is separated into two divisions as described above, a wide space W5 between the divisions 108*b*1 and 108*b*2 allows the band of the isolation to be broad.

According to the present embodiment, the division 108*b*2 of the third main segment 108*b* has a width larger than the width of the other division 108*b*1, thereby enhancing the rigidity. Accordingly, when the magnetic assembly 15*a* is assembled by folding the third line conductor 108 around the magnetic plate 5, the deformation of the third line conductor 108 can be prevented. Furthermore, the small width of the division 108*b*1 decreases the insertion loss.

The electrode unit 116 with the structure described above has the body 110A of the common electrode 110 disposed on the lower surface (one surface) of the magnetic plate 5. The common electrode 110 further has the first line conductor 106, the second line conductor 107, and the third conductor 108 folded on the upper surface (the other surface) of the magnetic plate 5 and the entire common electrode 110 is mounted on the magnetic plate 5. In this manner, the common electrode 110, along with the magnetic plate 5, forms the magnetic assembly 15*a*.

The first main segment 106*b* and the second main segment 107*b* have the structures described above. Accordingly, when the first main segment 106*b* and the second main segment 107*b* are disposed along the upper surface (the other surface) of the magnetic plate 5, the main segments 106*b* and 107*b* intersect on the surface of the magnetic plate 5. FIG. 9 shows the case where the central portions 106E and 107E are overlapped.

According to the present embodiment, the horizontal length of the first main segment 106*b* and second main segment 107*b* in the intersection 35*a* is defined as follows: as shown in FIG. 9, a length L7, i.e., a horizontal length of the overlapped area between one division 106*b*1 of the central portion 106E and one division 107*b*1 of the central portion 107E, or a length L8, i.e., a horizontal length of the overlapped area between the other division 106*b*2 of the central portion 106E and the other division 107*b*2 of the central portion 107E. In this case, the lengths L7 and L8 (the horizontal lengths of the overlapped area of the divisions) are preferably 10% or more, more preferably 20% or more, of the length L4 (the length wherein the main segments are overlapped on the upper surface (the other surface) of the magnetic plate 5) because of the reason described above.

The overlapped area between the divisions 106*b*1 and 107*b*1 includes a parallel portion 36*a* and not-parallel portion. The overlapped area between the divisions 106*b*2 and 107*b*2 includes a parallel portion 36*b* and not-parallel portion. The length of the parallel portion 36*a* is preferably about 20% to 60% of the length L7 (the length of the overlapped area of the divisions 106*b*1 and 107*b*1). The length of the parallel portion 36*b* is preferably about 20% to 60% of the length L8 (the length of the overlapped area of the divisions 106*b*2 and 107*b*2).

According to the present embodiment, the intersection angle of the overlapped area of the first main segment 106*b* and second main segment 107*b* in the intersection 35*a* is defined as follows: an intersection angle in the overlapped area between one division 106*b*1 of the central portion 106E and one division 107*b*1 of the central portion 107E, or an intersection angle in the overlapped area between another division 106*b*2 of the central portion 106E and another division 107*b*2 of the central portion 107E. In this case, the intersection angle is preferably 30° or less, more preferably 15° or less because of the reason described above. As in the present embodiment, when the overlapped area of the two divisions has the parallel portion 36*a*, the intersection angle of the divisions in the parallel portion 36*a* is 0° or substantially 0° and the intersection angle of the divisions in the not-parallel portion is preferably from 5° to 45°.

The magnetic assembly 15*a* is disposed in the bottom center of the bottom yoke component 103. A capacitor chip 12 is also disposed at one side of the magnetic assembly 15*a*. Capacitor chips 111*a* and 111*b* are disposed at the other side of the magnetic assembly 15*a*. The capacitor chip 12 has the terminator 13 mounted on one end thereof.

The terminal segment 106*c* of the first line conductor 106 is electrically connected to a capacitor electrode formed at the capacitor chip 111*a*, the terminal segment 107*c* of the second line conductor 107 is electrically connected to a capacitor electrode formed at the capacitor chip 111*b*, and the terminal segment 108*c* of the third central conductor 108 is electrically connected to the capacitor chip 12 and the terminator 13, whereby the capacitor chips 111*a*, 111*b*, and 12 and the terminator 13 are connected to the magnetic assembly 15*a*. A non-reciprocal circuit element with the structure of this embodiment functions as a circulator when the terminator 13 is disconnected.

The end of the capacitor chip 111*b* to which the terminal segment 107*c* is connected functions as a first port P1 of the non-reciprocal circuit element 101, the end of the capacitor chip 111*a* to which the terminal segment 106*c* is connected functions as a second port P2 of the non-reciprocal circuit element 101, and the end of the terminator 13 to which the terminal segment 108*c* is connected functions as a third port P3 of the isolator 101.

According to the isolator 101 of the present invention, the overlapped area of the two divisions includes not only the parallel portion but also the not-parallel portion. This structure decreases the insertion loss of the non-reciprocal circuit element and improves the property of the isolation, in particular, allows the band of the isolation to be broad.

EXAMPLE 1

$Y_2O_3$ powder, $Gd_2O_3$ powder, $Fe_2O_3$ powder, $Al_2O_3$ powder, and $In_2O_3$ powder were mixed together. The mixture was dried and calcinated at 1,200° C. for two hours to form the calcinated material. Then the calcinated material and organic binders are charged in a ball mill and wet milling was performed for 20 hours. The crushed mixture was sintered at 1,450° C. in air or in oxygen to produce garnet ferrite samples.

The garnet ferrite in this example had a formula Y—Gd—Fe—In—Al—O. Following Table 1 shows the compositions of the each element of the garnet ferrite. In Table 1, Sample No. 1 to No. 22 include compositions according to the present invention and Sample No. 23 to No. 27 include reference compositions, that is, do not have the composition of the present invention.

A temperature coefficient at 25° C., a ferromagnetic resonance half-width ΔH (a half-width of the peak indicating imaginary part ΔH of loss term in each sample), and a saturation magnetization (4πMs) were measured in each sample of the garnet ferrite. Table 1 summarizes the results.

The following relations were calculated by multivariate analysis based on the results in shown in Table 1: the relationships between the contents of Gd and In and the temperature coefficients, when the content of Al is constant; and the relationships between the contents of Gd and In and the ferromagnetic resonance half-widths ΔH, when Al content is constant.

Figure 11:
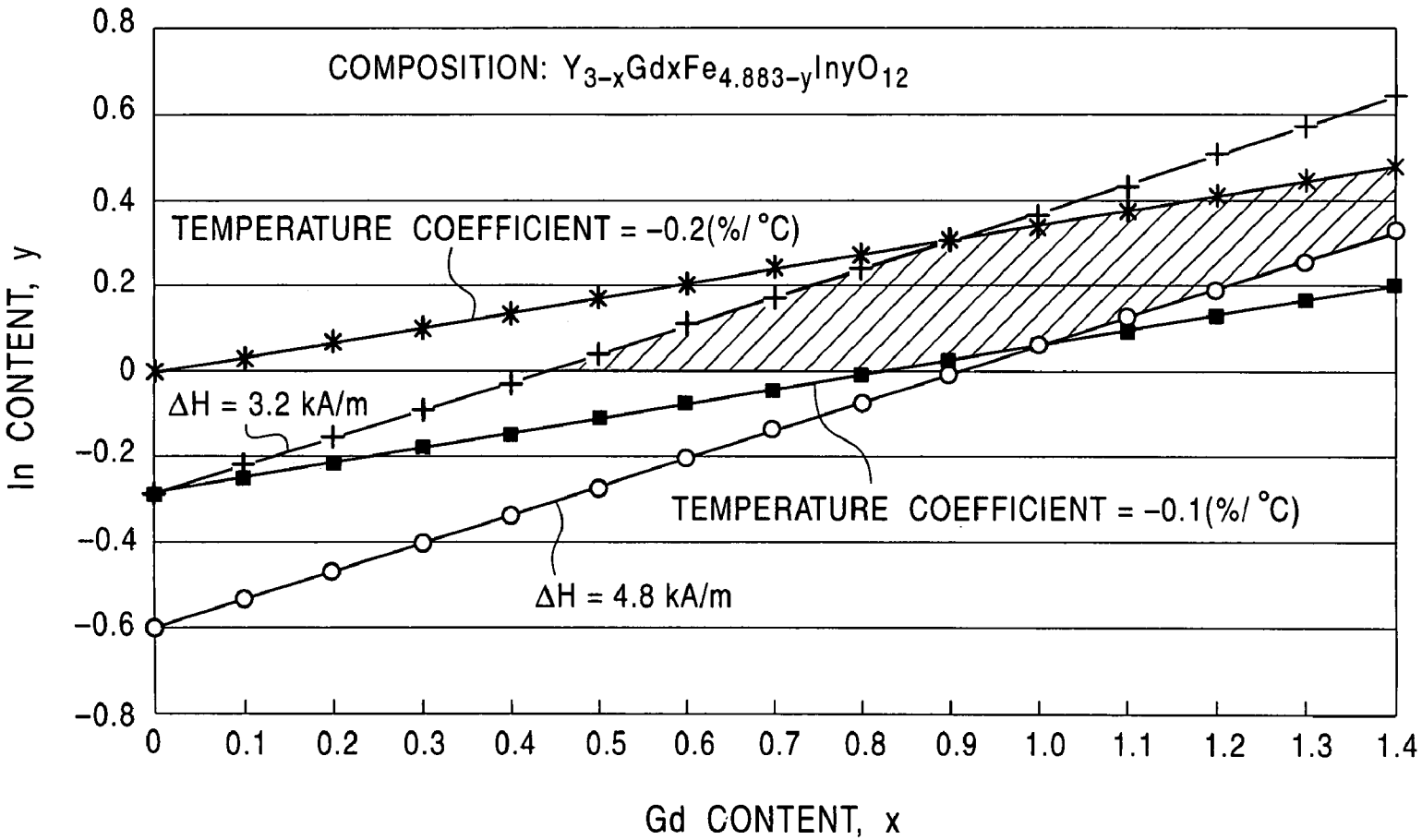
FIG. 11 is a graph showing relationships between stoichiometric ratios of In and Gd and temperature coefficients and ferromagnetic resonance half-widths ΔH in the case where the stoichiometric ratio of Al is constant at 0.

In more detail, referring to FIG. 11, the horizontal axis α-axis) indicates the Gd content and the vertical axis (y-axis) indicates the In content. An isogram indicating temperature coefficient=−0.1%/° C., an isogram indicating temperature coefficient=−0.2%/° C., an isogram indicating ΔH=3.2 kA/m, and an isogram indicating ΔH=4.8 kA/m are plotted in the figure. FIGS. 11 to 15 show the results of the following five components (1) to (5).

TABLE 1

| Sample No. | Y Content | Gd Content | Fe Content | In Content | Al Content | O Content | ΔH (kA/m) | 4πMs (T) | Temperature Coefficient (%/° C.) |
|---|---|---|---|---|---|---|---|---|---|
| 1 | 2.5 | 0.5 | 4.553 | 0.0 | 0.33 | 12 | 4.40 | 0.112 | −0.1727273 |
| 2 | 2.0 | 1.0 | 4.553 | 0.0 | 0.33 | 12 | 7.84 | 0.085 | 0 |
| 3 | 2.0 | 1.0 | 4.453 | 0.1 | 0.33 | 12 | 4.32 | 0.095 | −0.1363636 |
| 4 | 2.0 | 1.0 | 4.353 | 0.2 | 0.33 | 12 | 3.60 | 0.101 | −0.1818182 |
| 5 | 2.0 | 1.0 | 4.253 | 0.3 | 0.33 | 12 | 3.68 | 0.106 | −0.2272727 |
| 6 | 2.0 | 1.0 | 4.780 | 0.1 | 0.00 | 12 | 4.96 | 0.140 | −0.1272727 |
| 7 | 2.0 | 1.0 | 4.680 | 0.1 | 0.10 | 12 | 4.64 | 0.126 | −0.1272727 |
| 8 | 2.0 | 1.0 | 4.580 | 0.1 | 0.20 | 12 | 4.16 | 0.112 | −0.1363636 |
| 9 | 2.1 | 0.9 | 4.680 | 0.1 | 0.10 | 12 | 4.56 | 0.133 | −0.1454545 |
| 10 | 2.2 | 0.8 | 4.680 | 0.1 | 0.10 | 12 | 3.44 | 0.137 | −0.1545455 |
| 11 | 2.3 | 0.7 | 4.680 | 0.1 | 0.10 | 12 | 2.88 | 0.144 | −0.1636364 |
| 12 | 2.1 | 0.9 | 4.470 | 0.1 | 0.25 | 12 | 4.24 | 0.106 | −0.1363636 |
| 13 | 2.2 | 0.8 | 4.510 | 0.0 | 0.25 | 12 | 4.48 | 0.108 | −0.1363636 |
| 14 | 2.3 | 0.7 | 4.530 | 0.0 | 0.25 | 12 | 4.40 | 0.111 | −0.1454545 |
| 15 | 1.9 | 1.1 | 4.515 | 0.1 | 0.25 | 12 | 4.64 | 0.101 | −0.1272727 |
| 16 | 1.8 | 1.2 | 4.493 | 0.1 | 0.25 | 12 | 5.28 | 0.098 | −0.1181818 |
| 17 | 1.9 | 1.1 | 4.473 | 0.1 | 0.25 | 12 | 4.00 | 0.103 | −0.1363636 |
| 18 | 2.0 | 1.0 | 4.430 | 0.1 | 0.25 | 12 | 4.56 | 0.105 | −0.1363636 |
| 19 | 1.7 | 1.3 | 4.370 | 0.2 | 0.25 | 12 | 5.76 | 0.095 | −0.1181818 |
| 20 | 2.0 | 1.0 | 4.630 | 0.0 | 0.15 | 12 | 6.00 | 0.110 | −0.0909091 |
| 21 | 1.8 | 1.2 | 4.550 | 0.1 | 0.11 | 12 | 4.96 | 0.115 | −0.1090909 |
| 22 | 1.7 | 1.3 | 4.380 | 0.2 | 0.20 | 12 | 6.96 | 0.102 | −0.1363636 |
| 23 | 3.0 | 0.0 | 4.553 | 0.0 | 0.33 | 12 | 1.44 | 0.140 | −0.2272727 |
| 24 | 2.8 | 0.2 | 4.553 | 0.0 | 0.33 | 12 | 2.32 | 0.127 | −0.2090909 |
| 25 | 3.0 | 0.0 | 4.503 | 0.1 | 0.33 | 12 | 1.36 | 0.142 | −0.2454545 |
| 26 | 3.0 | 0.0 | 4.353 | 0.2 | 0.33 | 12 | 0.96 | 0.149 | −0.3 |
| 27 | 3.0 | 0.0 | 4.153 | 0.4 | 0.33 | 12 | 1.12 | 0.148 | −0.3545455 |

(1) $Y_{3-x}Gd_xFe_{5-y}In_yO_{12}$ (x = 0 to 1.4, y = 0 to 0.65),
(2) $Y_{3-x}Gd_xFe_{4.9-y}In_yAl_{0.1}O_{12}$ (x = 0 to 1.4, y = 0 to 0.7),
(3) $Y_{3-x}Gd_xFe_{4.8-y}In_yAl_{0.2}O_{12}$ (x = 0 to 1.4, y = 0 to 0.7),
(4) $Y_{3-x}Gd_xFe_{4.7-y}In_yAl_{0.3}O_{12}$ (x = 0 to 1.4, y = 0 to 0.75), and
(5) $Y_{3-x}Gd_xFe_{4.5-y}In_yAl_{0.5}O_{12}$ (x = 0 to 1.4, y = 0 to 0.8).

Referring to FIG. 11, the isogram indicating temperature coefficient=−0.1%/° C. and the isogram indicating temperature coefficient=−0.2%/° C. are substantially parallel to each other. The isogram indicating ΔH=3.2 kA/m, and the isogram indicating ΔH=4.8 kA/m are substantially parallel to each other. The isograms indicating the ΔH have slopes larger than those of the isogram indicating the temperature coefficients. Accordingly, an area enclosed with the four isograms is generated in FIG. 11. Specifically, the area indicates that the temperature coefficient is from −0.2%/° C. to −0.1%/° C. and the ΔH is from 3.2 kA/m to 4.8 kA/m. The area is further limited to the area where the content of In is 0 or more, because the negative content of In is impossible.

The shaded portion in FIG. 11 shows the portion enclosed with the four isograms. The compositions of the garnet ferrite in the shaded portion are preferable compositions in the present invention. When the content of Al is 0, the content of Gd is preferably 0.4 or more, the content of In is preferably from 0 to 0.5.

Figure 12:
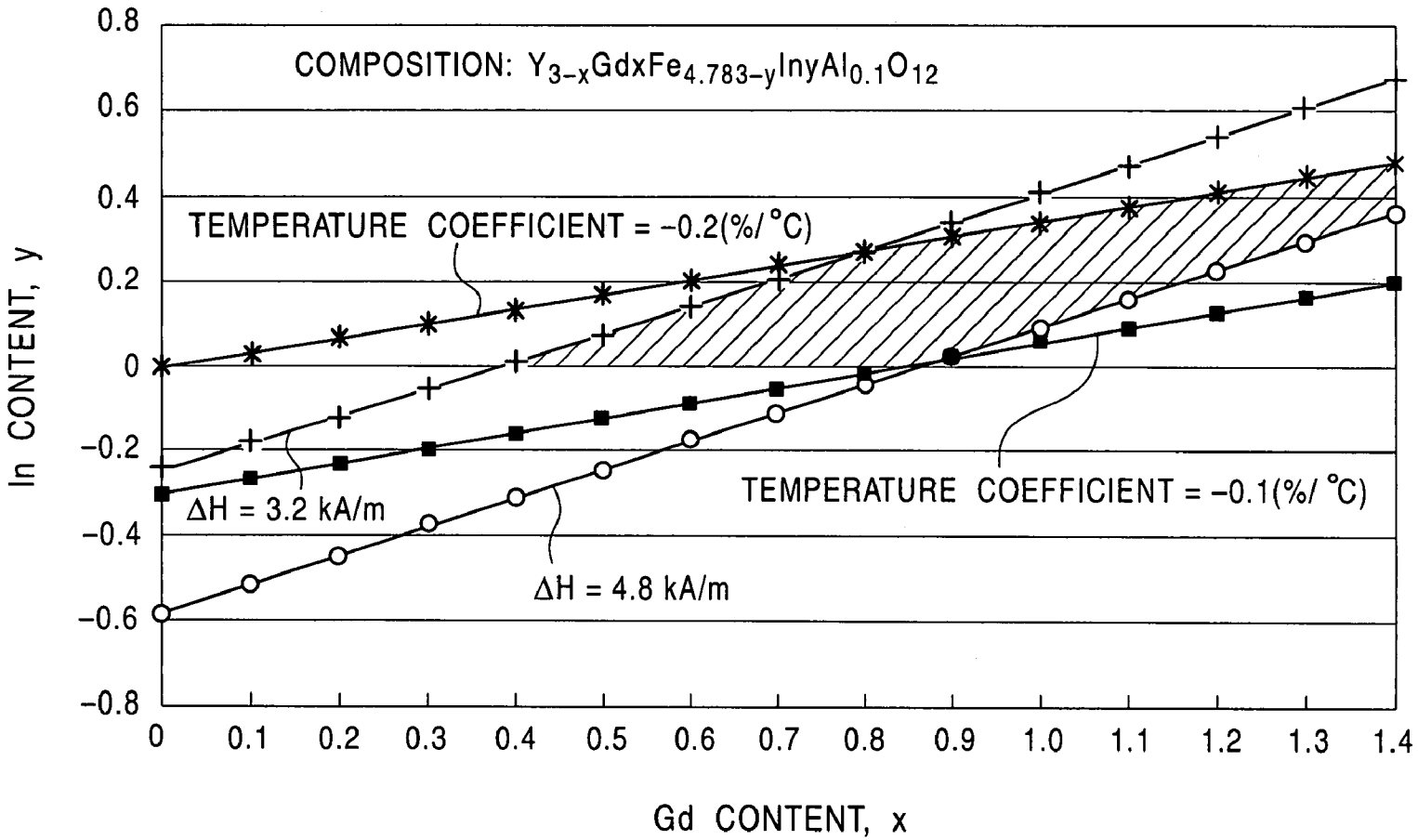
FIG. 12 is a graph showing relationships between stoichiometric ratios of In and Gd and temperature coefficients and ferromagnetic resonance half-widths ΔH in the case where the stoichiometric ratio of Al is constant at 0.1.
Figure 13:
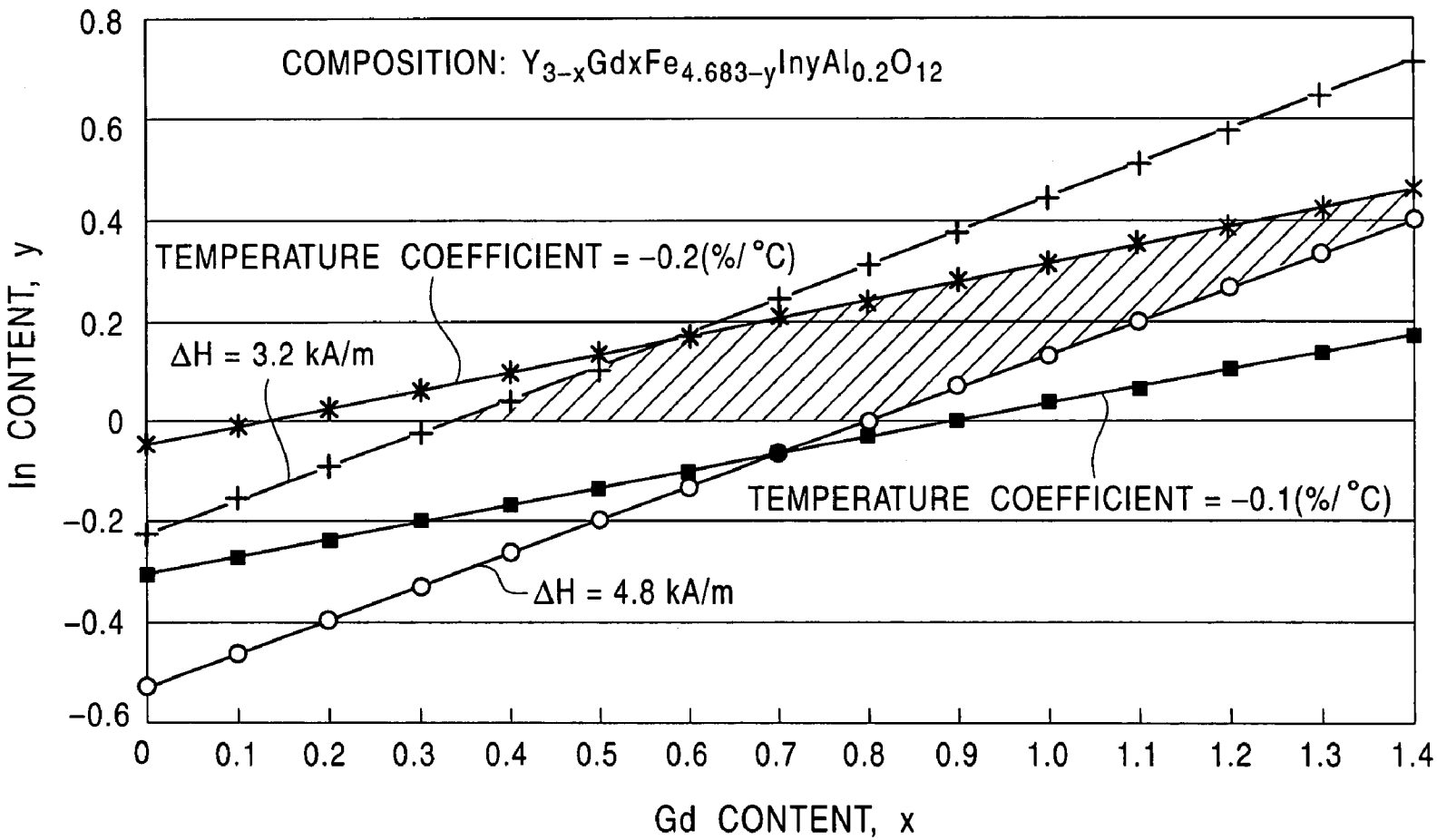
FIG. 13 is a graph showing relationships between stoichiometric ratios of In and Gd and temperature coefficients and ferromagnetic resonance half-widths ΔH in the case where the stoichiometric ratio of Al is constant at 0.2.
Figure 14:
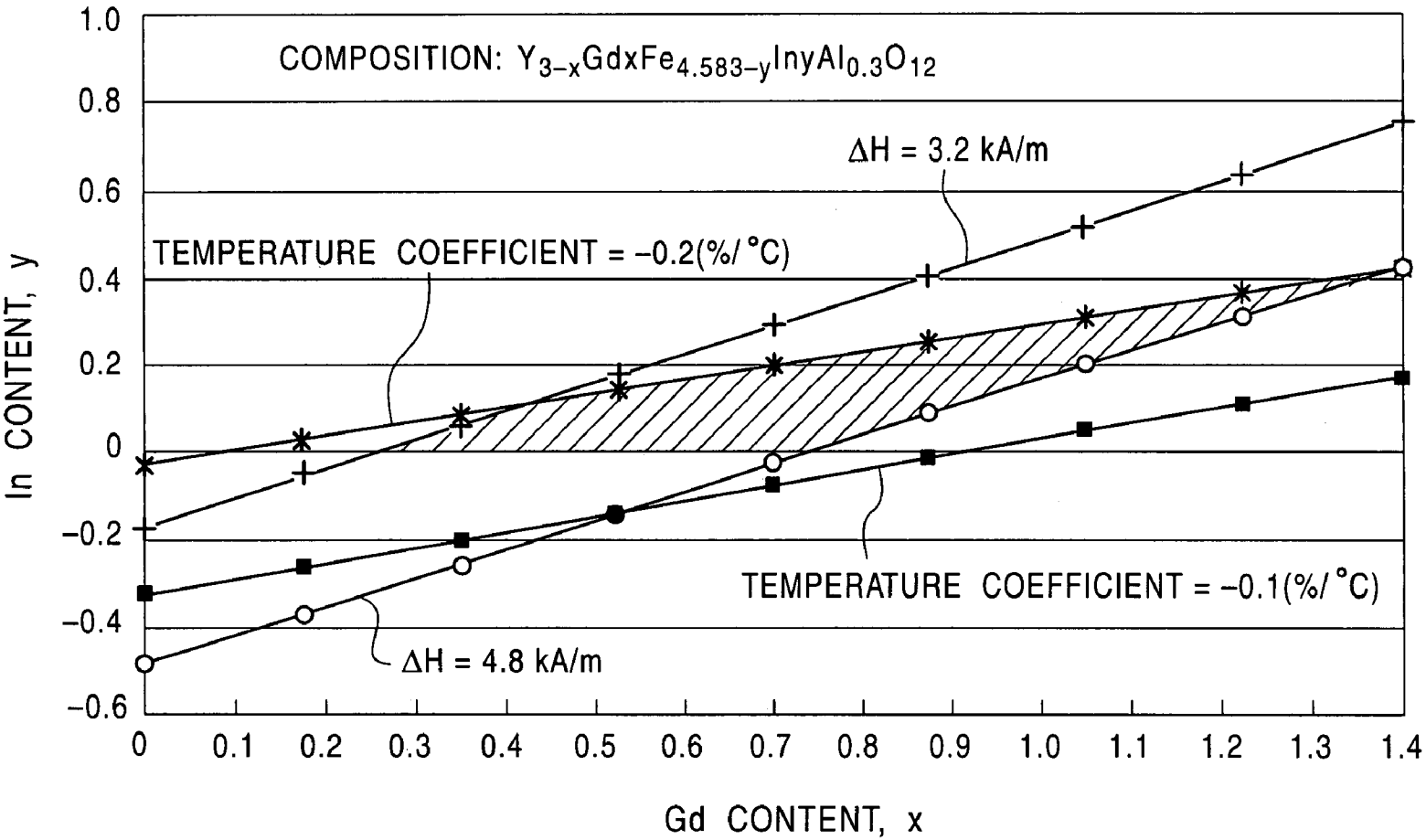
FIG. 14 is a graph showing relationships between stoichiometric ratios of In and Gd and temperature coefficients and ferromagnetic resonance half-widths ΔH in the case where the stoichiometric ratio of Al is constant at 0.3.
Figure 15:
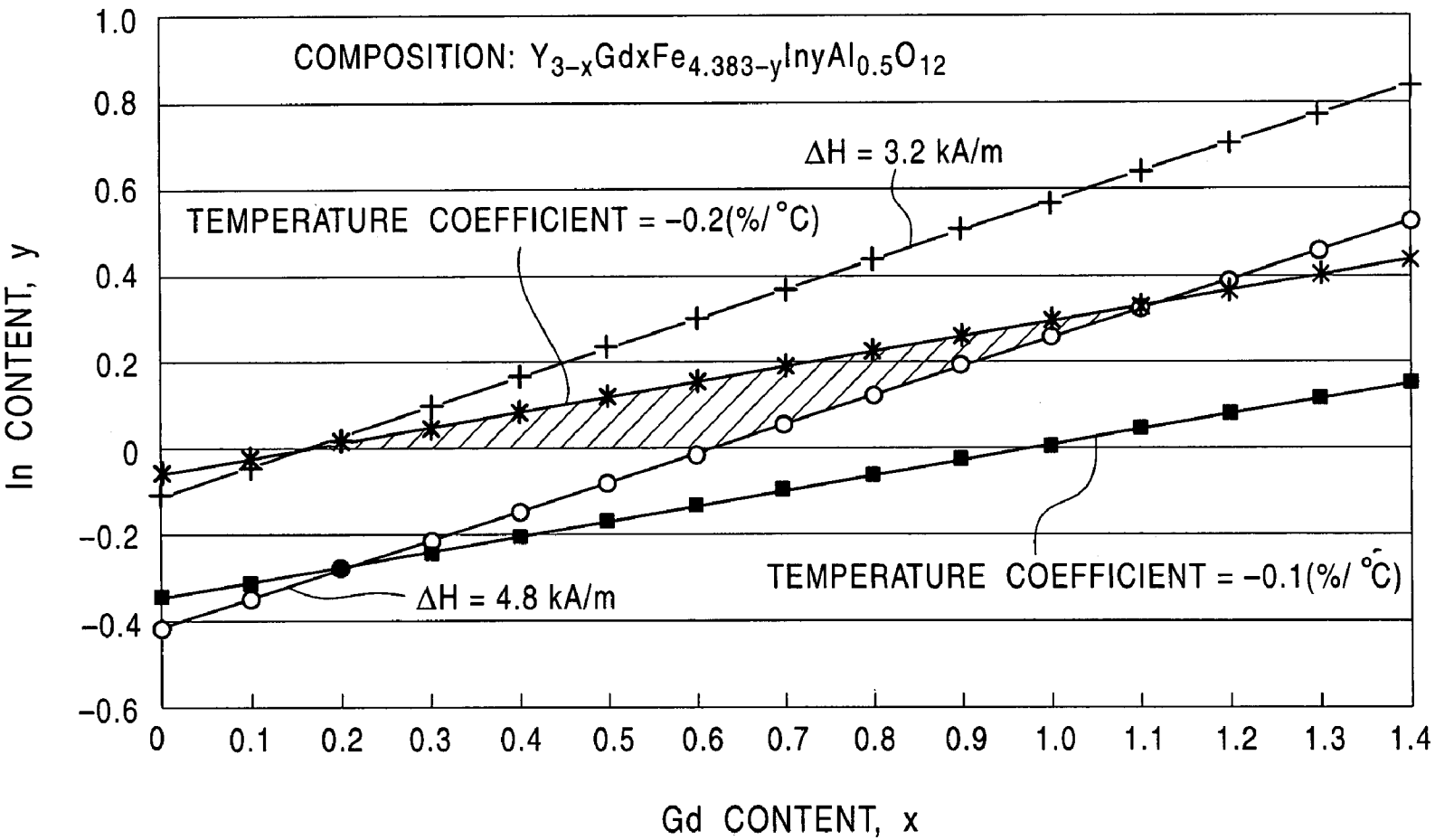
FIG. 15 is a graph showing relationships between stoichiometric ratios of In and Gd and temperature coefficients and ferromagnetic resonance half-widths ΔH in the case where the stoichiometric ratio of Al is constant at 0.5.

Referring to FIG. 12, when the content of Al is constant at 0.1, the content of Gd is preferably 0.4 or more and the content of In is preferably from 0 to 0.45. Referring to FIG. 13, when the content of Al is constant at 0.2, the content of Gd is preferably 0.33 or more and the content of In is preferably from 0 to 0.45. Referring to FIG. 14, when the content of Al is constant at 0.3, the content of Gd is preferably from 0.3 to 1.5 and the content of In is preferably from 0 to 0.45. Referring to FIG. 15, when the content of Al is constant at 0.5, the content of Gd is preferably from 0.1 to 1.05 and the content of In is preferably from 0 to 0.3.

Accordingly, the content of Gd is preferably from 0.3 to 1.5, the content of In is preferably from 0 to 0.6, and the content of Al is preferably from 0 to 0.5.

EXAMPLE 2

Garnet ferrite samples having the shape shown in FIG. 2 were produced as in Example 1 but the compositions of the garnet ferrite were $Y_2Gd_1Fe_{4.453}In_{0.1}Al_{0.33}O_{12}$ (Sample No. 31), $Y_2Gd_1Fe_{4.583}In_{0.1}Al_{0.2}O_{12}$ (Sample No. 32), and $Y_3Gd_1Fe_{4.37}Al_{0.54}O_{12}$ (Sample No. 33). Sample No. 31 and Sample No. 32 include compositions according to the present invention and Sample No. 33 includes a reference composition.

Electrode units shown in FIG. 3 and the garnet ferrite samples were assembled to form magnetic assemblies. The magnetic assemblies and ferrite magnets having a temperature coefficient of −0.18%/° C. at 25° C. were accommodated in yokes composed of soft iron to produce isolators shown in FIGS. 1A, 1B, and 2.

The temperature coefficient at 25° C. and the ferromagnetic resonance half-width ΔH were measured in each sample of the garnet ferrite. Furthermore, the insertion loss at a frequency of 0.926 GHz was measured in each isolator. The peak frequencies of the isolator were measured at −35° C., 25° C. (normal temperature), and 85° C. The shift in the peak frequencies between −35° C. and the normal temperature and the shift in the peak frequencies between 85° C. and the normal temperature were measured. Table 2 summarizes the results.

TABLE 2

| Sample No. | Composition of Magnetic plate | ΔH (kA/m) | Saturation Magnetization 4πMs (T) | Temperature Coefficient (%/° C.) | Insertion Loss (dB) | Peak Frequencies of Isolation (Shift from Peak Frequency at Normal Temperature (25° C.)) (MHz) −35° C. | 25° C. | 85° C. |
|---|---|---|---|---|---|---|---|---|
| 31 | $Y_2Gd_1Fe_{4.453}In_{0.1}Al_{0.33}O_{12}$ | 4.32 | 0.095 | −0.14 | 0.362 | 933.5 (5.5) | 928.0 | 940.2 (12.2) |
| 32 | $Y_2Gd_1Fe_{4.583}In_{0.1}Al_{0.2}O_{12}$ | 4.16 | 0.112 | −0.14 | 0.361 | 921.0 (6.3) | 914.7 | 928.8 (14.1) |
| 33 | $Y_3Gd_1Fe_{4.37}Al_{0.54}O_{12}$ | 1.84 | 0.107 | −0.30 | 0.361 | 912.9 (−26.7) | 939.6 | 968.8 (29.2) |

Referring to Table 2, each of the garnet ferrite in Sample No. 31 and Sample No. 32 has a ΔH larger than that of the garnet ferrite reference sample, i.e., Sample No. 33 that does not have the composition of the present invention. Although the saturation magnetization (4πMs) and the insertion loss of each of the garnet ferrite in Sample No. 31 and Sample No. 32 are equal to those of Sample No. 33, each of the garnet ferrite in Sample No. 31 and sample No. 32 has a temperature coefficient within the range of the present invention. Furthermore, according to the isolators using Sample No. 31 and Sample No. 32, the shifts in the peak frequencies of the isolation are remarkably smaller than those of Sample No. 33 both at the low temperature (−35° C.) and the high temperature (85° C.). As described above, the non-reciprocal circuit element of the present invention stably operates within a wide range of temperature.

What is claimed is:

1. A non-reciprocal circuit element, comprising:

a magnetic plate;

a common electrode disposed at a first face of the magnetic plate;

a first main segment;

a second main segment;

a third main segment; the three main segments extending from a periphery of the common electrode in three directions so as to surround the magnetic plate, the three main segments being folded to a second face of the magnetic plate and intersecting on the second face with predetermined angles, and a magnet for applying a bias magnetic field, the magnet opposing the magnetic plate, wherein a temperature coefficient of a saturation magnetization of the magnetic plate is from −0.2%/° C. to −0.1%/° C. in a temperature range from −35° C. to 85° C.; a temperature coefficient of a residual magnetization of the magnet is from −0.20%/° C. to −0.15%/° C. in a temperature range from −35° C. to 85° C.; and, the magnetic plate comprises garnet ferrite represented by the formula;

$$Y_{3-x}R_xFe_{5-y-z}M_yAl_zO_{12}$$

wherein R is at least one element selected from the group consisting of La, Ce, Pr, Nd, Pm, Sm, Eu, Gd, Tb, Dy, Ho, Er, Tm, Yb, and Lu, M is In or a combination of Ca and Sn or a combination of Ca and Zr, and subscripts x, y, and z representing a stoichiometric ratio satisfy $0.3 \leqq x \leqq 1.5$, $0 \leqq y \leqq 0.6$, and $0 \leqq z \leqq 0.5$.

2. The non-reciprocal circuit element according to claim 1, wherein the horizontal length of an overlapped area between the first main segment functioning as an input and the second main segment functioning as an output is 10% or more of the horizontal length of the main segments overlapping on the second face of the magnetic plate.

3. The non-reciprocal circuit element according to claim 1, wherein each of the first main segment functioning as an input and the second main segment functioning as an output is connected to matching capacitors and the third main segment is connected to another matching capacitor and a terminator.

4. A communication device, comprising:

a non-reciprocal circuit element according to claim 1;

a transmitting circuit connected to the first main segment functioning as an input of the non-reciprocal circuit element; and an aerial connected to the second main segment functioning as an output of the non-reciprocal circuit element.

5. A non-reciprocal circuit element, comprising:

a magnetic plate;

a common electrode disposed at a first face of the magnetic plate;

a first main segment;

a second main segment;

a third main segment; the three main segments extending from a periphery of the common electrode in three directions so as to surround the magnetic plate, the three main segments being folded to a second face of the magnetic plate and intersecting on the second face with predetermined angles, and a magnet for applying a bias magnetic field, the magnet opposing the magnetic plate, wherein a temperature coefficient of a saturation magnetization of the magnetic plate is from −0.2%/° C. to −0.1%/° C. in a temperature range from −35° C. to 85° C.; a temperature coefficient of a residual magnetization of the magnet is from −0.20%/° C. to −0.15%/° C. in a temperature range from 35° C. to 85° C.; and, the magnetic plate comprises garnet ferrite represented by the formula:

$$Y_{3-x}R_xFe_{a-y-z}M_yAl_zO_{12}$$

wherein the element R is at least one element selected from the group consisting of La, Ce, Pr, Nd, Pm, Sm, Eu, Gd, Tb, Dy, Ho, Er, Tm, Yb, and Lu, M is In or a combination of Ca and Sn or a combination of Ca and Zr, and the subscripts a, x, y, and z representing the stoichiometric ratio satisfy $4.75 \leqq a \leqq 4.95$, $0.3 \leqq x \leqq 1.5$, $0 \leqq y \leqq 0.6$, and $0 \leqq z \leqq 0.5$.

6. The non-reciprocal circuit element according to claim 5, wherein a horizontal length of an overlapped area between the first main segment functioning as an input and the second main segment functioning as an output is 10% or more of a horizontal length of the main segments overlapping on the second face of the magnetic plate.

7. The non-reciprocal circuit element according to claim 5, wherein each of the first main segment functioning as an input and the second main segment functioning as an output is connected to matching capacitors and the third main segment is connected to another matching capacitor and a terminator.

8. A communication device, comprising:

a non-reciprocal circuit element according to claim 5;

a transmitting circuit connected to the first main segment functioning as an input of the non-reciprocal circuit element; and an aerial connected to the second main segment functioning as an output of the non-reciprocal circuit element.

* * * * *